US005757945A

United States Patent [19]

Sakamoto

[11] Patent Number: 5,757,945

[45] Date of Patent: May 26, 1998

[54] TERMINAL FOR SPEAKER

[75] Inventor: Yoshio Sakamoto, Tokyo, Japan

[73] Assignee: Kabushiki Kaisha Kenwood, Tokyo, Japan

[21] Appl. No.: 630,782

[22] Filed: Apr. 10, 1996

Related U.S. Application Data

[63] Continuation-in-part of Ser. No. 572,073, Dec. 14, 1995.

[30] Foreign Application Priority Data

Apr. 12, 1995 [JP] Japan ..... 7-110298
Jun. 15, 1995 [JP] Japan ..... 7-171589

[51] Int. Cl.[6] ..... H04R 25/00

[52] U.S. Cl. ..... 381/194; 381/197

[58] Field of Search ..... 381/194, 197, 381/202, 199, 188; 181/171, 172

[56] References Cited

U.S. PATENT DOCUMENTS 3,014,996 12/1961 Swanson ..... 381/197
4,465,905 8/1984 Nation .

FOREIGN PATENT DOCUMENTS 0361642 4/1990 European Pat. Off. .
0720415 7/1996 European Pat. Off. .
3318346 11/1984 Germany .
63-146684 6/1988 Japan ..... 381/202
63-164793 7/1988 Japan ..... 381/202

*Primary Examiner*—Sinh Tran
*Attorney, Agent, or Firm*—Sixbey, Friedman, Leedom & Ferguson, P.C.; Gerald J. Ferguson, Jr.; Eric J. Robinson

[57] ABSTRACT

A speaker, and its manufacturing method, is disclosed where the speaker includes a speaker component of an integral structure which has a damper made of a base member having concentric corrugations and an opening formed generally at the center thereof and a tinsel wire being disposed around the corrugations, a ring member made of insulating material mounted on the damper, and a voice coil bobbin inserted into the opening of the damper and having a wound coil electrically connected to one end of the tinsel wire. The speaker further includes a terminal lug mounted on the ring member and terminally connected to an end of an input lead wire at one end and to the tinsel wire at the other end, a diaphragm that is coupled to the voice coil bobbin, a speaker frame, and a magnetic circuit fixed to the speaker frame. This speaker and its method of manufacture provide an improved speaker having a damper with a conductive member, reducing the man power required for mounting the input terminal, and improving the quality of the product.

4 Claims, 29 Drawing Sheets

TERMINAL FOR SPEAKER

This is a continuation-in-part of U. S. application Ser. No. 08/572,073, filed Dec. 14, 1995, pending.

BACKGROUND OF THE INVENTION

1. Field of the Invention

The present invention relates to a speaker and its manufacturing method, and more particularly to a speaker whose damper for supporting a vibrating system has a voice input conductive member, and its manufacturing method.

Specifically, the voice input conductive member is made of a flat knitted tinsel wire sewn or woven traversing concentric corrugations of the damper. The damper is made of a woven cloth or the like impregnated with thermosetting resin such as phenol resin and thermally molded.

2. Related Background Art

Various types of vibrating system supporting dampers with a voice input conductive member have been proposed. However, only a few dampers are practically used.

The present inventors have proposed a speaker and its manufacturing method having a vibrating system supporting damper with a voice input conductive member which is made of a flat knitted tinsel wire sewn or woven traversing concentric corrugations of the damper made of a woven cloth or the like impregnated with thermosetting resin such as phenol resin and thermally molded.

This speaker and its manufacturing method will be described with reference to FIGS.14 to 20. As a damper 1 with a conductive member, a damper 1*h* with a conductive member made of a flat knitted tinsel wire 2 sewn traversing corrugations 11 is used. Two methods of manufacturing such a speaker are generally used. The first manufacturing method assembles vibration system components after input terminal 4 and components of a magnetic circuit 9 are mounted on a speaker frame 8. Specifically, as shown in FIG. 14, the magnetic circuit 9 is assembled at a magnetic circuit assembly line Lm. In sequentially assembling the components of the magnetic circuit 9 including a yoke 90, a magnet 91, and a top plate (hereinafter abbreviated as "platen") 92, the yoke 90 and magnet 91 are supplied to the line Lm from a yoke supply apparatus Sal and a magnet supply apparatus Sa2, respectively, and the plate 92 is supplied from a plate supply apparatus Sa3 to a plate/frame coupling apparatus K2.

The input terminal 4 is mounted on the frame 8 by a caulking apparatus K1 or the like, and the frame 8 with the terminal 4 is supplied to the plate/frame coupling apparatus K2. Generally the plate 92 has studs 92*d* corresponding to mount holes formed in the bottom 82 of the frame 8. The plate 92 is generally mounted on the frame 8 by inserting the studs 92*d* into the mount holes and caulking the studs 92*d* by a press machine. If the studs are not formed on the plate, projection welding is generally performed. In either case, the frame 8 with the plate assembled by the plate/frame coupling apparatus K2 is supplied to the magnetic circuit assembly line Lm which assembles the yoke 90 and magnet 91.

After the assembly process of the magnetic circuit 9, the frame 8 with the plate is transported to a vibrating system assembly line Ld1. The speaker frame 8 has already the magnetic circuit 9 mounted on the bottom 82 thereof for driving a voice coil 5. Specifically, as shown in FIG. 15, a magnetic gap 9*g* between a pole 90*p* of the yoke 90 and the plate 92 is disposed at the central area of the frame bottom 82. The frame 8 has a step commonly called a damper seat 81 at a predetermined position over the bottom 82. This damper seat 81 is used for adhering to an adhesive margin 12 of the damper 1*h* with the sewn conductive member. At a predetermined position outward of the damper seat 81, a terminal mount 83 in a tongue shape is provided to mount thereon the input terminal 4.

The structure of a general input terminal 4 and its connecting method will be described. Terminal lugs 41 of the input terminal are mounted on a fiber substrate 42 at predetermined positions, generally by caulking as shown in FIG. 16. A substrate fixing square eyelet 43 is pressure-fitted in a square hole formed in the substrate 42 at generally the central area. Another square hole for fixing the input terminal substrate 42 is also formed in the terminal mount 83 of the frame 8 at a predetermined position (generally at the center). The input terminal 4 with the eyelet is set to a caulking jig of a caulking apparatus K1 made of a press machine or the like. The eyelet 43 of the input terminal 4 is inserted into the terminal fixing square hole of the frame, and a caulking bit of the press machine is lowered to caulk the square eyelet 43. In this manner, the input terminal 4 is mounted on the terminal mount 83. Since FIG. 16 shows the state after the caulking, the fixing square holes of the frame 83 and fiber substrate are not shown. Similar to a general input terminal, the input terminal 4 has the terminal lugs 41 mounted on the fiber substrate 42 at the predetermined positions, and the terminal lugs 41 have tongues 411 as shown in FIG. 16.

In assembling the vibrating system, particularly the voice coil 5 and damper 1*h* with the sewn conductive member, a jig (hereinunder called a "spacer") J is inserted along the inner circumference of the voice coil 5 in order to correctly position the voice coil 5 in the magnetic gap 9*g*, and a coil bobbin 51 is inserted along the inner circumference 13 of the damper 1*h*. In this case, input copper foil electrodes 52 attached to the outer circumference of the coil bobbin 51 at predetermined positions are aligned with the end portions 22 of the flat knitted tinsel wires 2 sewn on the damper 1*h*. In this manner, the voice coil 5 and damper 1*h* with the sewn conductive member are mounted on the speaker frame 8.

The damper 1*h* with a sewn conductive member, as the damper 1 with the conductive member, is manufactured in the following manner. Phenol resin diluted to a predetermined density by methanol is impregnated into a woven cloth. After the methanol is volatilized to remove resin tack, the woven cloth is cut to have a predetermined width. Two flat knitted tinsel wires 2 are sewn along the central line of the woven cloth in parallel at a predetermined distance therebetween. Then, a plurality of concentric corrugations 11, adhesive margin, and other parts are formed by thermally molding. After this molding, the inner circumference to be coupled to the voice coil 5 and the outer shape of the damper is trimmed by a punching press machine to obtain the final shape of the damper 1*h* with the sewn conductive member. Tongues 14 having predetermined widths and lengths extend out of the adhesive margin 12 of the damper 1*h* with the sewn conductive member, and the end portions 21 of the flat knitted tinsel wires extend to the tongues 14.

After adhesive h is coated on the damper seat by a predetermined amount as illustrated in FIG. 16, the voice coil 5 together with the spacer J is inserted into the magnetic gap 9*g* while aligning the tongues 14 of the damper 1*h* with the input terminal lugs 41 mounted on the frame 8. Therefore, the adhesive margin 12 of the damper 1*h* is adhered to the damper seat 81, with the tongues 14 extending out of the adhesive margin 12 being positioned above the terminal lugs 41. In order to clearly distinguish between the first manufacturing method and the second manufacturing method illustrated in FIG. 20, the voice coil 5 and damper 1*h* are intentionally shown spaced apart from each other in FIG. 16. The lug tongues 411 are bent toward the flat knitted tinsel wires 2 to make the tongues and wires contact each other. These contact areas are soldered with solder s. The input copper foil electrodes at the outer circumference of the coil bobbin 51 and the end portions of the flat knitted tinsel wires 22 at the inner circumference 13 of the damper 1*h* are also soldered to complete the electrical connection to the voice coil 5 and input terminal 4.

After the completion of electrical connections, adhesive h is coated over the whole circumferential contact area between the outer circumference of the coil bobbin 51 and the inner circumference of the damper 1*h* to adhere the coil bobbin 51 and damper 1*h* together, and also coated over the soldered area between the copper foil electrodes at the outer circumference of the bobbin 51 and the end portions of the flat knitted tinsel wires 2. In this manner, mounting the voice coil 5 and damper 1 with the sewn conductive member on the speaker frame is completed. The method of manufacturing the speaker after the damper 1*h* is mounted, is similar to the conventional method. This method will be briefly described. An edge adhesive area formed at the top of the frame 8 is coated with adhesive h. The coil bobbin 51 is inserted along the inner circumference of a cone diaphragm to align an adhesive margin of an edge provided at the outer circumference of the cone diaphragm with the edge adhesive area of the frame 8, and the edge is adhered to the frame 8. Adhesive h is coated over the whole circumferential contact area between the inner circumference of the diaphragm and the outer circumference of the coil bobbin 51 to adhere both the circumferences together. Thereafter, the spacer J inserted in the gap 9*g* of the magnetic circuit on the inner side of the voice coil 5 is removed. A chamber or dust cap, and the like are adhered to the diaphragm at predetermined positions, and the magnet 91 is magnetized to complete the speaker.

The second manufacturing method has the same assembly process as the first manufacturing method, with respect to the speaker frame 8, input terminal 4, and the components of the magnetic circuit 9. However, the second manufacturing method is slightly different from the first manufacturing method in the assembly of the components of the vibrating system. As shown in FIG. 19, the voice coil 5 and damper 1*h* with the sewn conductive member are assembled at another line Ls. The assembled device is then supplied to a main line Ld1. This method will be described in detail. The spacer J is inserted along the inner circumference of the coil bobbin 51 similar to the first embodiment. The voice coil 5 together with the spacer J is set to a jig (hereinafter called a "setting jig") for adhering the voice coil 5 and the damper 1*h* with the sewn conductive member. Next, the damper 1*h* is set to the setting jig. In this case, similar to the first manufacturing method, the coil bobbin 51 is inserted along the inner circumference 13 of the damper 1*h*, while aligning the input copper foil electrodes 52 at the outer circumference of the coil bobbin 51 with the end portions 22 of the flat knitted tensile wires at the inner circumference 13 of the damper 1*h*. With the voice coil 5 and damper 1*h* being set to the setting jig, the input copper foil electrodes 52 and the end portions 22 of the flat knitted tensile wires at the inner circumference of the damper 1*h* are soldered. Adhesive h is coated over the whole circumference contact area between the outer circumference of the coil bobbin 51 and the inner circumference of the damper 1*h*. After the adhesion strength reaches a predetermined value, the voice coil 5 together with the spacer J is dismounted from the setting jig. In this manner, as shown in FIG. 20, a damper 1*v* with the conductive member and the voice coil 5 being adhered thereto can be obtained. This damper 1*v* is mounted on the frame 8 with the magnetic circuit. The method of mounting this damper 1*v* is the same as the first manufacturing method. After adhesive h is coated on the damper seat by a predetermined amount, the damper 1*v* with the voice coil together with the spacer J is inserted into the magnetic gap 9*g* while aligning the tongues 14 on the adhesive margin 12 of the damper 1*h* with the input terminal lugs 41 mounted on the frame 8. Therefore, the adhesive margin 12 of the damper 1*h* is adhered to the damper seat 81, with the tongues 14 extending out of the adhesive margin 12 being positioned above the terminal lugs 41. The lug tongues 41 are bent toward the flat knitted tinsel wires 2 to solder the tongues and the end portions 22 of the flat knitted tinsel wires contacting each other. Since the electrical connection between the coil bobbin 5 and the end portions 2 of the flat knitted tinsel wires has already been made, the whole electrical connections between the voice coil 5 and input terminal 4 are therefore completed by this soldering. After this process, the processes similar to the first manufacturing method are performed. These processes (second manufacturing method) is generally widely used when the height precision of the voice coil 5 is required .

The conventional first and second manufacturing methods described above have reduced the number of speaker wiring processes greatly as compared to a conventional speaker wiring work using a string type tinsel wire. Reducing a man power required for a 20 speaker assembly is to reduce the processes of mounting the input terminal 4. However, if a conventional mount structure of the input terminal 4 is used, the terminal is required to be mounted on the frame 8 in the manner described above.

The disadvantage of the terminal mounting method described above is a difficulty in automation. Consider for example the processes of setting the terminal 4 to a caulking jig and correctly positioning the frame 8 to the terminal mount position. Since the frame 8 has a larger size than other speaker components, particularly the frame 8 of a cone type woofer speaker has a complicated shape, the frame 8 is not suitable for transportation and handling and hence for automation. Furthermore, since the position of the input terminal mount 83 is at the middle height of generally a basket shape of the frame 8, it is not suitable for handling the input terminal 4 for mounting it to the frame 8 and hence for automation. The shape of the frame 8, the terminal mount position, and the input terminal mount structure have been determined from long past experiences.

However, if the shape of the frame 8, the terminal mount position, or the input terminal mount structure is modified simply for the ease of automation, it is likely to raise the cost and sacrifice part of the speaker performance. From this reason, the shape of the frame 8 or the terminal mount 83 described above have been used commonly, and the terminal mounting method described above has been used commonly.

A conventionally proposed damper with the conductive member does not use the flat knitted tinsel wire 2. A conventionally proposed damper with an input terminal disposed at the outer circumference thereof is not practical for automation of speaker manufacturing. Any definite manufacturing method has not been suggested for these conventional dampers.

With the conventional manufacturing method, it is difficult to reserve a space for an inspection process of wiring connections. Even if the inspection process can be performed at the line LD1, a defective speaker found during the inspection process is required to be dismounted from the speaker manufacturing line LD1, together with the magnetic circuit, because the magnetic circuit has already been assembled with the frame 8. It is therefore necessary to prepare a space for placing the dismounted defective speaker, or the handling and repair work of the speaker with the frame 8 being mounted becomes complicated. From this or other reasons, a wiring connection inspection has not been performed before assembling the vibrating system, particularly before mounting the diaphragm. The wiring work has been therefore performed basically at the manufacturing line, and the performance inspection including the wiring inspection has been generally performed after the assembly completion of the speaker. In the wiring inspection process after the assembly completion of the speaker, a predetermined signal is inputted to the input terminal 4 to perform a conduction check, a polarity check, and the like. Another input sine wave signal having a desired frequency range, e.g., 20 Hz to 20 KHz, is applied to produce actual sounds in order to detect abnormal sounds, check the fundamental performance and a lowest resonance frequency (hereinafter abbreviated as "Fo"). These processes are inherently associated with a danger of a line stop or a lot-out at the worst if defective speakers are found during the inspection. Even if the speaker can be repaired, it is performed after the speaker is actually completed so that the repair work becomes complicate. In the case of the lot-out, the products may be discarded or disassembled.

A conventional compliance test of a damper is generally based upon a static compliance value representative of a measured displacement of the damper with a force being applied thereto. This test takes a lot of measurement time so that it is essentially a sampling test which is not a reliable and precise method. The static compliance value is not necessarily proper because a dynamic compliance is a more important factor of a speaker. A method of measuring a dynamic compliance is not known to date so that the specification allowance of Fo is set broader and the product quality is essentially difficult to be ensured.

SUMMARY OF THE INVENTION

It is an object of the present invention to provide a speaker and its manufacturing method capable of solving the above problems of a conventional speaker and further improving a speaker having a damper with the conductive member proposed by the present inventors, reducing the man power required for mounting the input terminal, and improving the product quality.

In order to solve the above object of the invention, a method of manufacturing a speaker is provided. A damper with a conductive member of a speaker previously proposed by the present inventors is effectively used and improved. This damper is constructed such that a ring made of insulating material such as resin is mounted on the damper with the conductive member at its outer circumferential area, input terminal lugs are mounted on the ring, and parts of the terminal lugs are electrically connected to the end portions of flat knitted tinsel wires extending to the outer circumference of the damper. In this invention, a voice coil, a damper with a conductive member, and a terminal ring are assembled at a sub-line or a different position and the wiring connection between the voice coil, flat knitted tinsel wires, and input terminal lugs are completed to form a single finished component of a ring assembly. Tests of conduction, Fo, and the like of the ring assembly are performed, and thereafter, the ring assembly is supplied to the speaker manufacturing main line to assemble a speaker.

The speaker manufactured in the above manner has the ring assembly made of the voice coil, damper with the conductive member, and terminal ring, the wiring connection being completed between the voice coil, flat knitted tinsel wires, and input terminal lugs.

With the speaker structure as above, it is possible to automatically mount input terminal lugs and the like so that man power can be reduced considerably. Furthermore, wiring connections between the voice coil and input terminal lugs are completed before a speaker is assembled. Therefore, conduction test, polarity test, and other tests can be performed at this time. The manufacture yield, product quality and performance can therefore be improved.

DETAILED DESCRIPTION OF THE PREFERRED EMBODIMENTS

Figure 1:
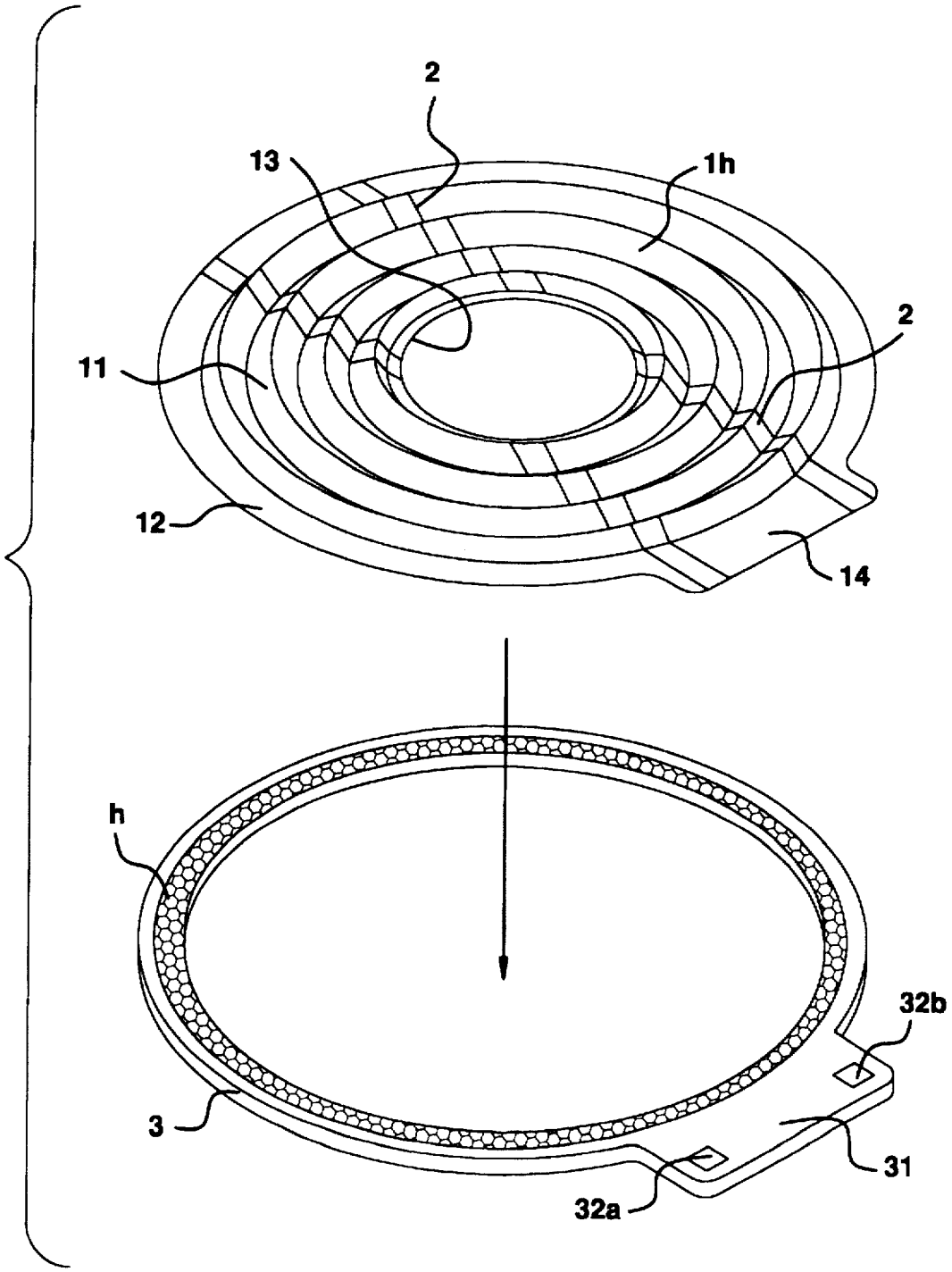
FIG. 1 is a perspective view of a damper with a conductive member and a terminal ring before the assembly, illustrating a method of manufacturing a speaker according to an embodiment of the invention.

Embodiments of a speaker and its manufacturing method will be described with reference to FIGS.1 to 13. Like constituent elements to a conventional speaker described with reference to FIGS.14 to 20 are represented by using identical reference numerals and the description thereof is omitted.

In a first embodiment, a woven cloth made of fibers generally called cornex is dipped in solution diluted with phenol and methanol of about 1:4.5, and is impregnated with phenol resin. After the solvent is evaporated to remove a tack nature of the resin, the cloth is cut to have a predetermined width. This cloth is used as the material of a damper 1 with a conductive member which is fundamentally the same as previously proposed by the present inventors.

A tin-copper alloy wire having a bus bar diameter of 0.1 mm is worked to a foil having a width of 0.32 mm and a thickness of 0.027 mm, and the foil is wound in a single layer at 22 +/1−2 turns/cm around a paraaramid fiber of 200 denier to form a tinsel wire. A bundle of tinsel wires is knitted flat at a knitting pitch of 27.45 +/−0.82 mm/turn to form a flat knitted tinsel wire 2 having a width of about 2.2 mm, a thickness of 0.44 mm, and an electric resistance of 0.48 Ω/M. Two flat knitted tinsel wires 2 are sewn in parallel on the damper 1 at the positions spaced by 10.5 mm (a pitch of about 21) from the center of the width of the cut woven cloth of the damper 1, by using a thread called cornex #40. The damper is then thermally molded to form a plurality of concentric corrugations 11 with the flat knitted tinsel wires 2 traversing the corrugations 11, as shown in FIG. 1.

After the thermal molding, unnecessary portions are removed by a punching press machine to obtain a damper 1*h* having a predetermined shape, with the flat knitted tinsel wires 2 being sewn traversing the corrugations 11 as the conductive member. The outer diameter of the damper 1*h* is 78 mm, and the inner diameter of an opening at the junction to a coil bobbin 51 is 26.3 mm. Seven corrugations 11 of about 2.4 mm deep are disposed at a pitch of about 2.8 mm from the area near the opening, and an adhesive margin 12 of about 8.5 mm wide is formed at the outer peripheral portion. A tongue 14 is formed outside of the adhesive margin 12, the tongue 14 being 28 mm wide at the position apart from the center of the damper 1*h* by 42.5 mm. The flat knitted tinsel wires extend to the tongue 14. The flat knitted tinsel wires 2 become about 3 mm wide after the press molding.

A terminal ring 3 has an inner diameter of 69.6 mm and an outer diameter of 79.2 mm. A tongue 31 having a width of 29 mm and a length of 7.7 mm such as shown in FIG. 1 is formed at the outer peripheral portion of the ring. In this embodiment, the ring 3 is 2 mm thick and is made of ABS resin. Square holes 32*a* and 32*b* respectively having side lengths of 2 mm and 2.5 mm are formed in the tongue 31 near at the width center symmetrically with the center line of the ring at a pitch of 21 mm same as that of the flat knitted tinsel wires 2 sewn on the damper 1*h*. The square hole 32*a* having a side length of 2 mm is used for mounting a positive input terminal lug 41*a*, and the square hole 32*b* having a side length of 2.5 mm is used for mounting a negative input terminal lug 41*b*.

In this embodiment, the terminal ring 3 is made of thermoplastic ABS resin. If heat resistance is important, other thermoplastic resins having excellent heat resistance may be used such as PEI, PES, and PPEK. Thermosetting resins may be used or phenol boards or galaepo resin boards used for printed circuit boards may also be used.

Figure 2:
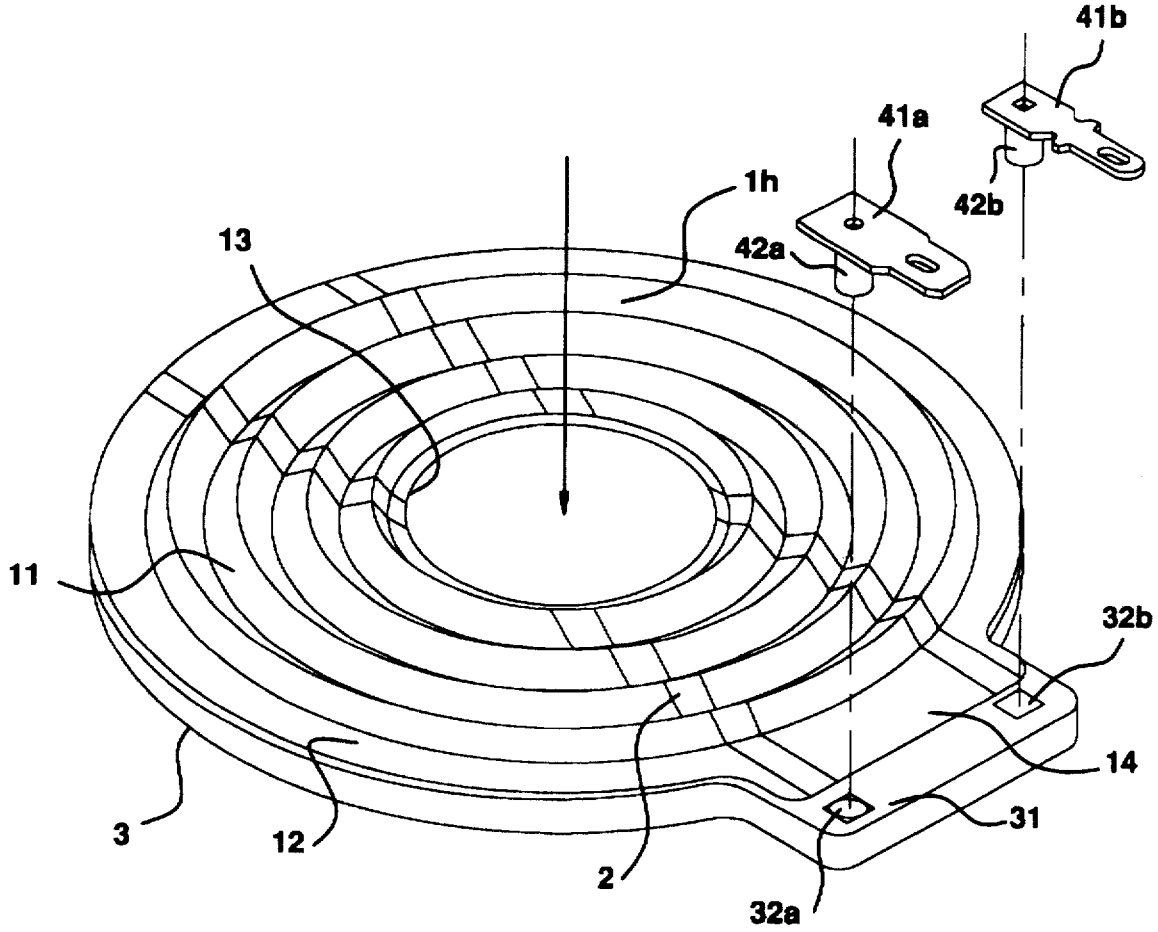
FIG. 2 is a perspective view showing the damper with a conductive member, after the terminal ring is attached thereto and before terminal lugs are mounted.
Figure 3:
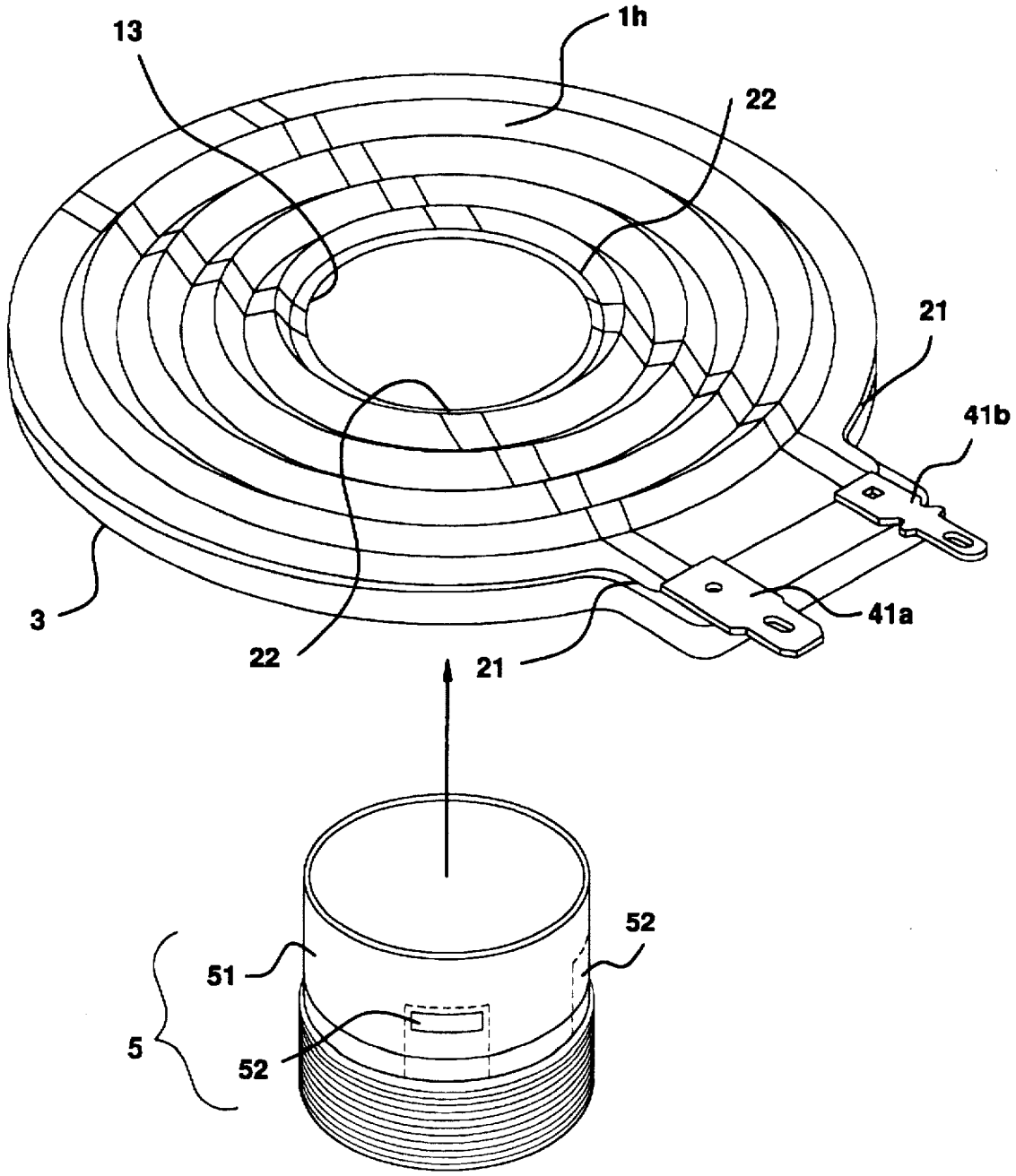
FIG. 3 is a perspective view showing the damper with a conductive member, after the terminal ring and terminal lugs are mounted and before a voice coil is mounted.

Rubber-based adhesive h is coated, as shown in FIG. 1, on the inner circumferential portion of the terminal ring 3 by a predetermined amount, and dried for a predetermined time to volatilize solvent of the adhesive. Thereafter, the terminal ring 3 is aligned with the adhesive margin 12 of the damper 1*h*, and the tongue 14 of the damper 1*h* and the tongue 31 of the terminal ring 3 are aligned in position. The adhesive h is thermally reactivated by thermally pressing the adhesive margin 12 of the damper 1*h* to secure the terminal ring 3 to the adhesive margin 12. In this embodiment, the rubber-based adhesive h is thermally reactivated to adhere the terminal ring 3 to the damper 1*h* with the sewn tinsel wires. Other adhesives may be used if they can provide a reliable adherence. As a means for coating adhesive, a roller coater or the like may be used, or melting adherence may be used without using the adhesive h. As shown in FIG. 2, after the damper 1*h* and terminal ring 3 are adhered together, caulking portions of the terminal lugs 41*a* and 41*b* are inserted into the holes 32*a* and 32*b* of the terminal ring 3 and caulked to mount them on the ring 3 while parts of the terminal lugs 41*a* and 41*b* are pressed against the surfaces of the end portions 21 of the flat knitted tinsel wires as shown in FIG. 3.

Figure 4:
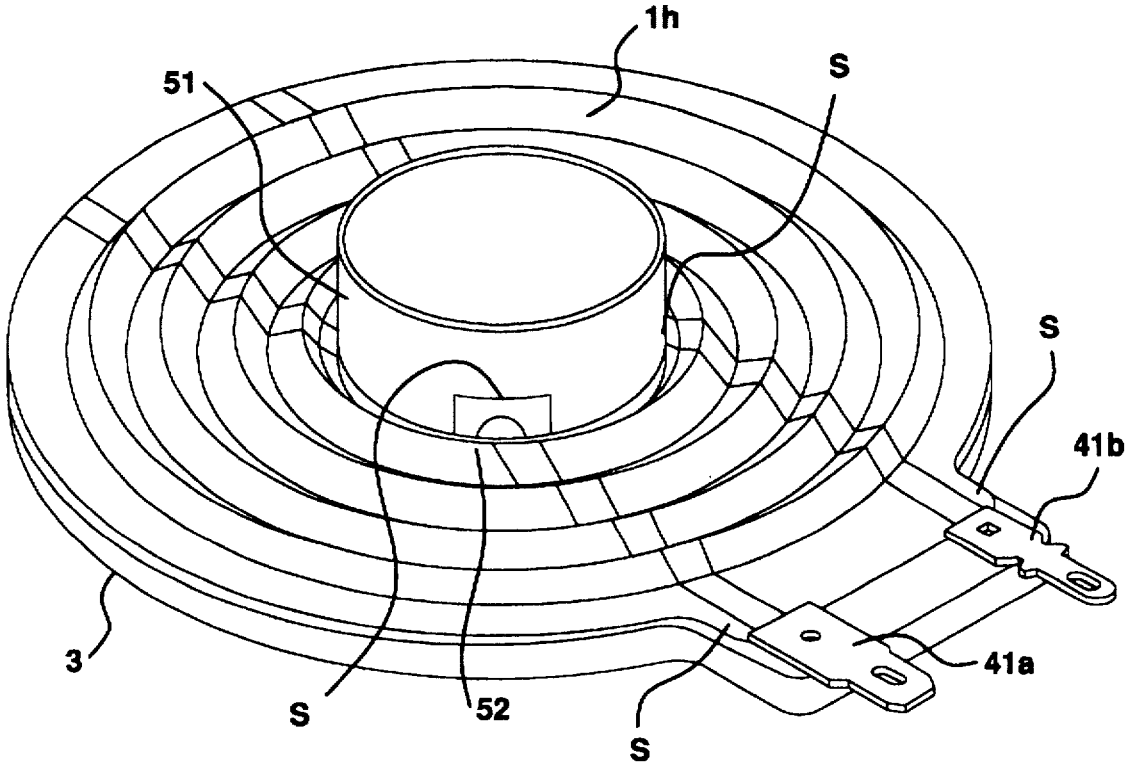
FIG. 4 is a perspective view showing the damper with a conductive member, after the terminal ring, terminal lugs, and voice coil are mounted and after the end portions of flat knitted tinsel wires are soldered to copper foil electrodes of the coil bobbin and to the terminal lugs.

A voice coil 5 is fundamentally the same as a conventional voice coil 5 excepting that the size of copper foil electrodes 52 is slightly different. As shown in FIG. 3, the outer circumference of the coil bobbin 51 is inserted into the inner hole 13 of the damper 1*h* with the sewn tinsel wires to assemble them. In practice, the inner circumference of the voice coil 5 is set to a setting jig at a predetermined position, and then the damper 1*h* with the sewn tinsel wires and the terminal ring is set to the setting jig to insert the outer circumference of the coil bobbin 51 into the inner hole 13 of the damper 1*h*. Similar to a conventional coil bobbin, the two copper foil electrodes 52 are attached to the outer circumference of the coil bobbin 51 at the predetermined positions corresponding to the flat knitted tinsel wires of the damper 1*h* with the sewn tinsel wires. The coil bobbin 51 is inserted by aligning the copper foil electrodes with the flat knitted tinsel wires extending to the inner hole of the damper 1*h* with the flat knitted tinsel wires. Under the condition of this setting by the setting jig, as shown in FIG. 4, the copper foil electrodes at the outer circumference of the coil bobbin 51 are soldered with solder s to the end portions of the flat knitted tinsel wires extending to the inner hole of the damper 1*h* with the flat knitted tinsel wires, and also the end portions of the flat knitted tinsel wires extending to the outer periphery of the damper 1*h* are soldered with solder s to the end portions of the terminal lugs 4.

Figure 5:
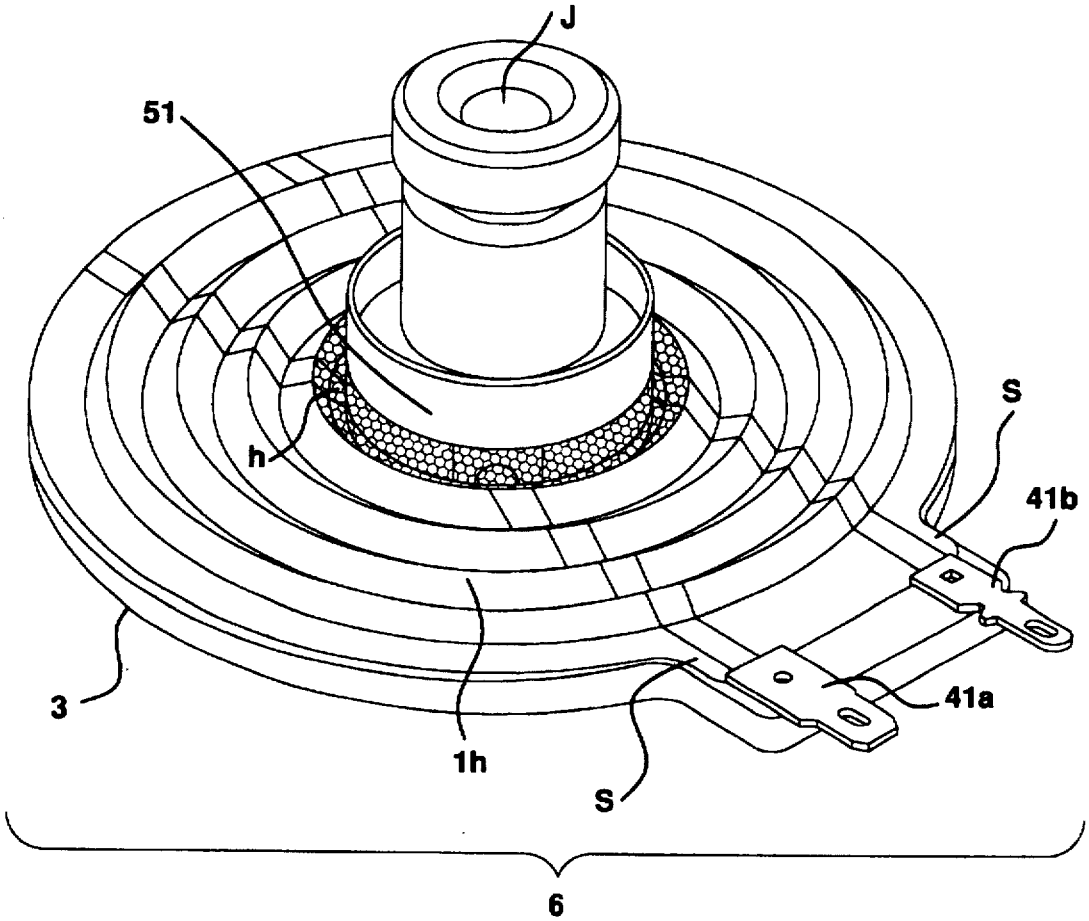
FIG. 5 is a perspective view of a ring assembly formed by assembling a damper with a conductive member, a terminal ring, terminal lugs, and voice coil, wiring them, and adhering the coil bobbin to the damper.
Figure 6:
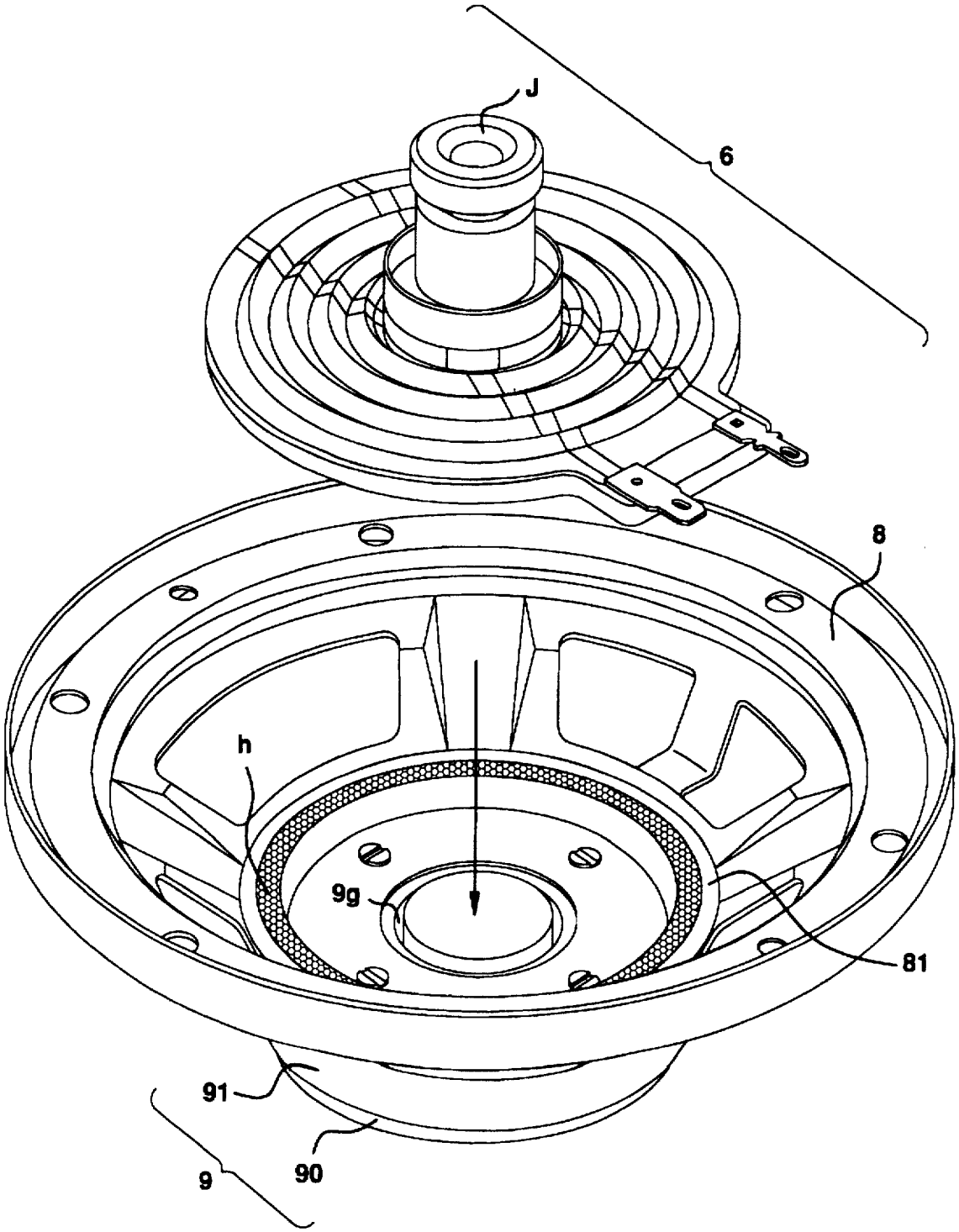
FIG. 6 is a perspective view of a ring assembly immediately before it is assembled as a speaker.
Figure 7:
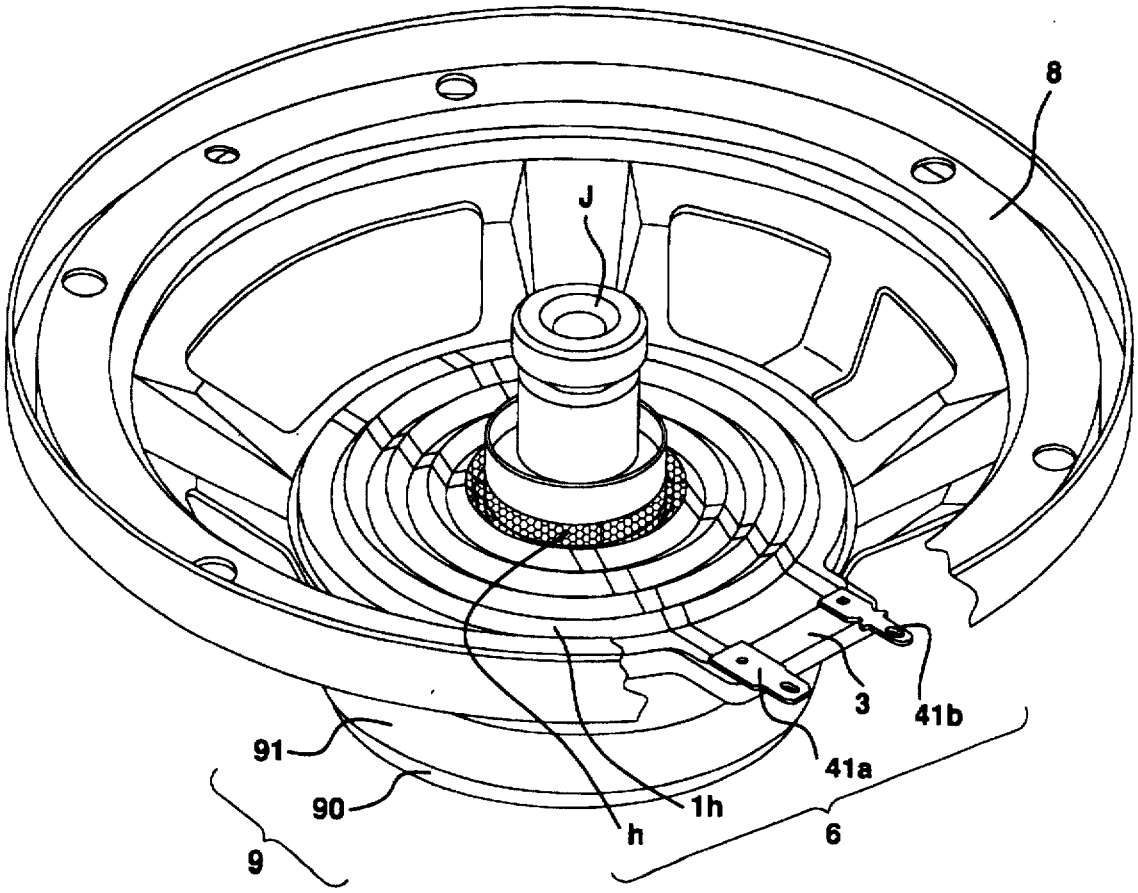
FIG. 7 is a perspective view of a speaker after the ring assembly together with a spacer is assembled as the speaker.
Figure 8:
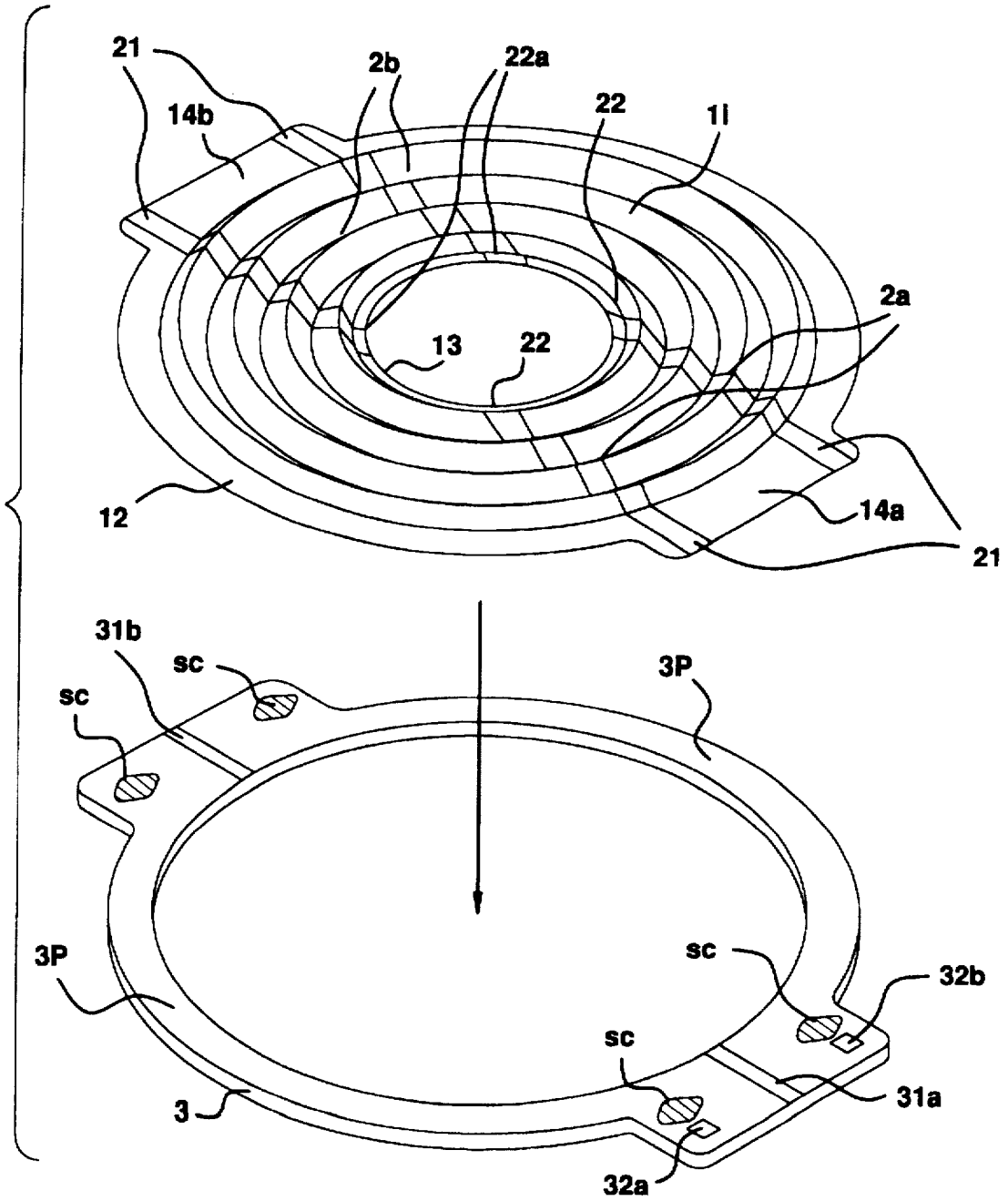
FIG. 8 is a perspective view of a damper with a conductive member and a terminal ring before assembling them according to a second embodiment.

Under these conditions, probes of a tester are made in contact with the terminal lugs 41*a* and 41*b* to check any broken wire and a resistance of the coil. Thereafter, similar to a conventional method, adhesive h is coated on the whole contact area between the outer circumference of the coil bobbin 51 and the inner hole 13 of the damper 1*h* to adhere the coil bobbin 51 and the damper 1*h* and to cover the soldered area of the outer circumference of the bobbin 51, as shown in FIG. 5. After a predetermined adhesion strength is obtained, the bobbin 51 and damper 1*h* are dismounted from the setting jig to complete a ring assembly 6. As shown in FIG. 5, a spacer J is inserted into the inner hole of the coil bobbin 5 of the ring assembly 6 to mount the ring assembly 6 on a frame 8. This mount method is similar to a conventional method. As shown in FIG. 6, after adhesive h is coated by a predetermined amount on a damper seat 81, the voice coil 5 mounted on the ring assembly 6 together with the spacer J is inserted into a magnetic gap 9*g*. Therefore, as shown in FIG. 7, the ring 3 of the ring assembly 6 is adhered to the damper seat 81. Since the wire connection between the voice coil 5 and the input terminal 4 has already been finished, the mount process and other processes for the ring assembly 6 are immediately performed to complete a speaker.

In this embodiment, it is assumed that at a line different from the main line LD1, the voice coil 5, damper 1*h* with the sewn flat tinsel wires, input terminal 4, and other components are assembled. Therefore, after the ring assembly 6 is completed, the spacer J is inserted. If they are assembled at a sub-line Ls capable of being installed near at the main line LD1, the voice coil 5 with the spacer J being inserted may be set to the setting jig to complete a speaker. Although a conduction and resistance test is performed prior to coating adhesive, this test process may be performed after the ring assembly 6 is completed.

In a second embodiment, fibers constituting a woven cloth are impregnated with phenol resin having a predetermined concentration after dilution by methanol. The solvent is evaporated to remove a tack nature of the resin. Thereafter, by using the resin impregnated fibers as a warp and a thread not impregnated with resin as a yarn, a woven cloth is formed by weaving flat tinsel wires 2 on the yarn side at a pitch of 21 mm. This woven cloth is then thermally molded to form a damper 1 with a conductive member (hereinafter called "damper 1*i* with a woven conductive member"). At a trimming process, two tongues 14*a* and 14*b* are formed at the outer periphery of the damper 1*h*, the flat tinsel wires 2 extending to the tongues 14*a* and 14*b*. The damper 1*i* with the woven conductive member as previously proposed by the present inventors has a feature that the conductive portion of the flat knitted tinsel wire exposes at the front and rear surfaces of the woven cloth because the flat knitted tinsel wire 2 is disposed at the center of the cross section of the woven cloth.

A terminal ring 3 is made of a printed circuit board of 2 mm thick and has a plurality of tongues 31, in this embodiment two tongues 31*a* and 31*b* radially spaced by 180 degrees. A conductive pattern 3P is deposited on the terminal ring 3 on the surface thereof corresponding in position to the adhesive margin of the damper 1*i* with the woven conductive member. Rubber-based adhesive h is coated on the inner circumferential portion of the terminal ring 3 by a predetermined amount, and dried for a predetermined time to volatilize solvent of the adhesive. Thereafter, cream solder sc is coated on the predetermined areas of the pattern 3P of the tongues 31*a*, i.e., at the areas where the flat knitted tinsel wires 21 of the damper 1*i* with the woven conductive member extend. The damper 1*i* and terminal ring 3 are disposed while aligning the damper adhesive margin 12 with the outer circumferential portion of the terminal ring 3 and the damper tongues 14*a* and 14*b* with the tongues 31*a* and 31*b* of the terminal ring 3. Under this condition, the adhesive margin 12 of the damper 1*i* with the woven conductive member contacts the adhesive h, and the cream solder sc contacts the conductive portion of the flat woven tinsel wires 2 exposed on the damper rear surface and extending to the tongues 14*a* and 14*b* of the damper 1*i* with the woven conductive member.

The damper 1*i* is thermally pressed for several seconds at about 250° C. from the upper side of the adhesive margin 12 of the damper 1*i* and the tongues 14*a* and 14*b* to thermally reactivate the adhesive h and adhering the adhesive margin 12 of the damper 1*i* with the woven conductive member to the terminal ring 3, and at the same time to melt the cream solder sc and solder the conductive pattern 3P of the terminal ring 3 to the conductive portion of the flat woven tinsel wires 2 exposed on the damper rear surface and extending to the tongues 14*a* and 14*b* of the damper 1*i* with the woven conductive member. Similar to the first embodiment, caulking portions of terminal lugs 41*a* and 41*b* are inserted into holes 32*a* and 32*b* of the terminal ring 3 and caulked to mount them on the ring 3.

Figure 9:
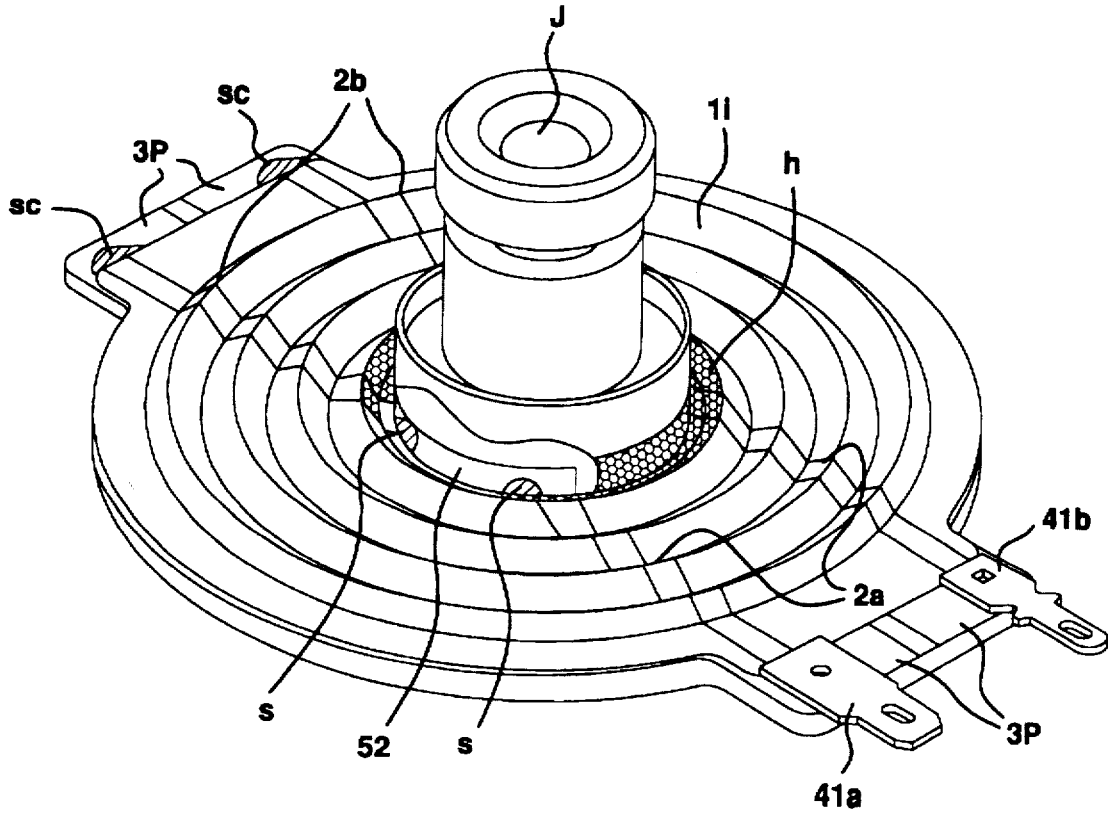
FIG. 9 is a perspective view of a ring assembly formed by assembling a damper with a conductive member, a terminal ring, terminal lugs, and voice coil according to the second embodiment.

A voice coil 5 is fundamentally the same as a conventional voice coil 5 excepting that as shown in FIG. 9, the size of copper foil electrodes 52 is changed so as to be able to contact also the end portions of the flat woven tinsel wires extending to the inner hole of the damper 1*i* with the woven conductive member on the opposite side of the input terminal. The inner circumference of the voice coil 5 is set to a setting jig at a predetermined position, and then the damper 1*i* with the terminal ring is set to the setting jig to insert the outer circumference of the coil bobbin 51 into the inner hole 13 of the damper 1*i* similar to the first embodiment. The coil bobbin 51 is inserted by aligning the copper foil electrodes 52 of the coil bobbin 51 with the end portions 22 and 22*a* of the flat knitted tinsel wires extending to the inner hole 13 of the damper 1*i* with the woven conductive member. Under the condition of this setting by the setting jig, the copper foil electrodes 52 are soldered to the end portions 22 and 22*a* of the flat knitted tinsel wires. The mount processes after this soldering process are similar to the first embodiment. In the above manner, a speaker is completed.

Figure 10:
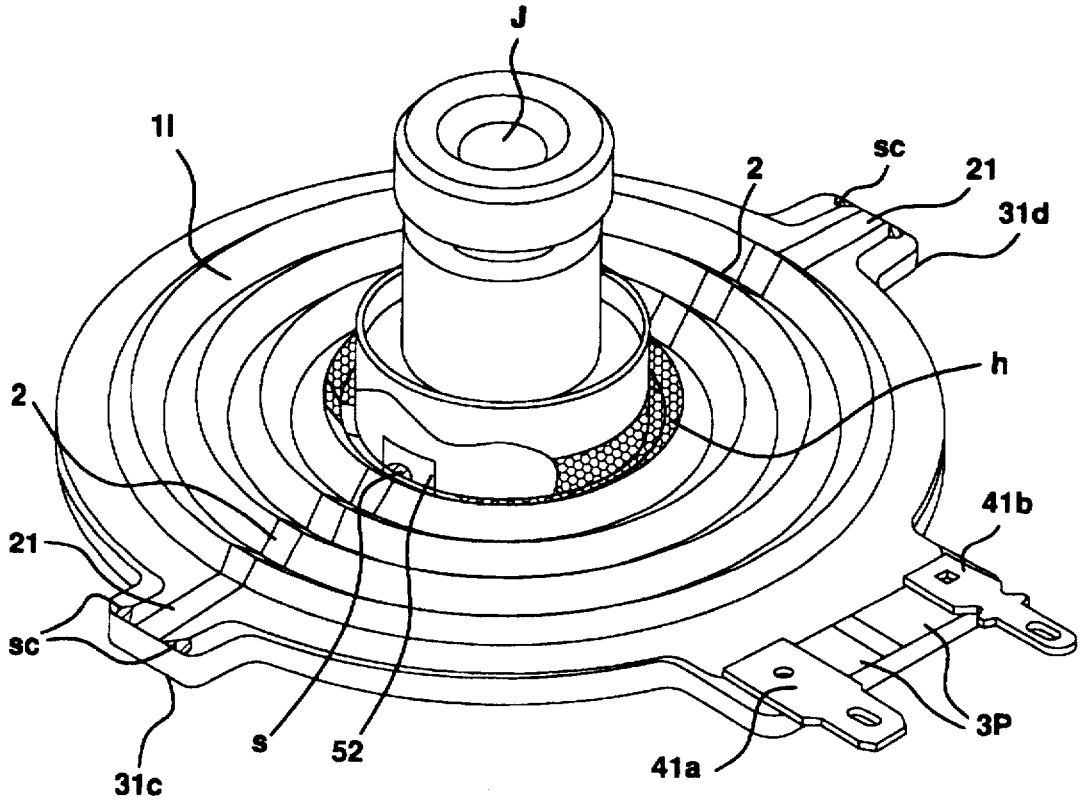
FIG. 10 is a perspective view of a ring assembly formed by assembling a damper with a conductive member, a terminal ring, terminal lugs, and voice coil according to a third embodiment.

The third embodiment is similar to the second embodiment except the following points. One flat knitted tinsel wire 2 is woven on the yarn side to form a woven cloth. This woven cloth is thermally molded to obtain a damper 1*i* with the woven conductive member. At the trimming process, two tongues 21 are formed at the damper outer circumference as shown in FIG. 10. The flat knitted tinsel wire 2 extends to the tongues 21. Tongues 31*c* and 31*d* are formed on the ring 3 at the positions corresponding to the tongues 21. A conductive pattern similar to the second embodiment is deposited. With the succeeding processes similar to the second embodiment, a speaker is manufactured.

Figure 11:
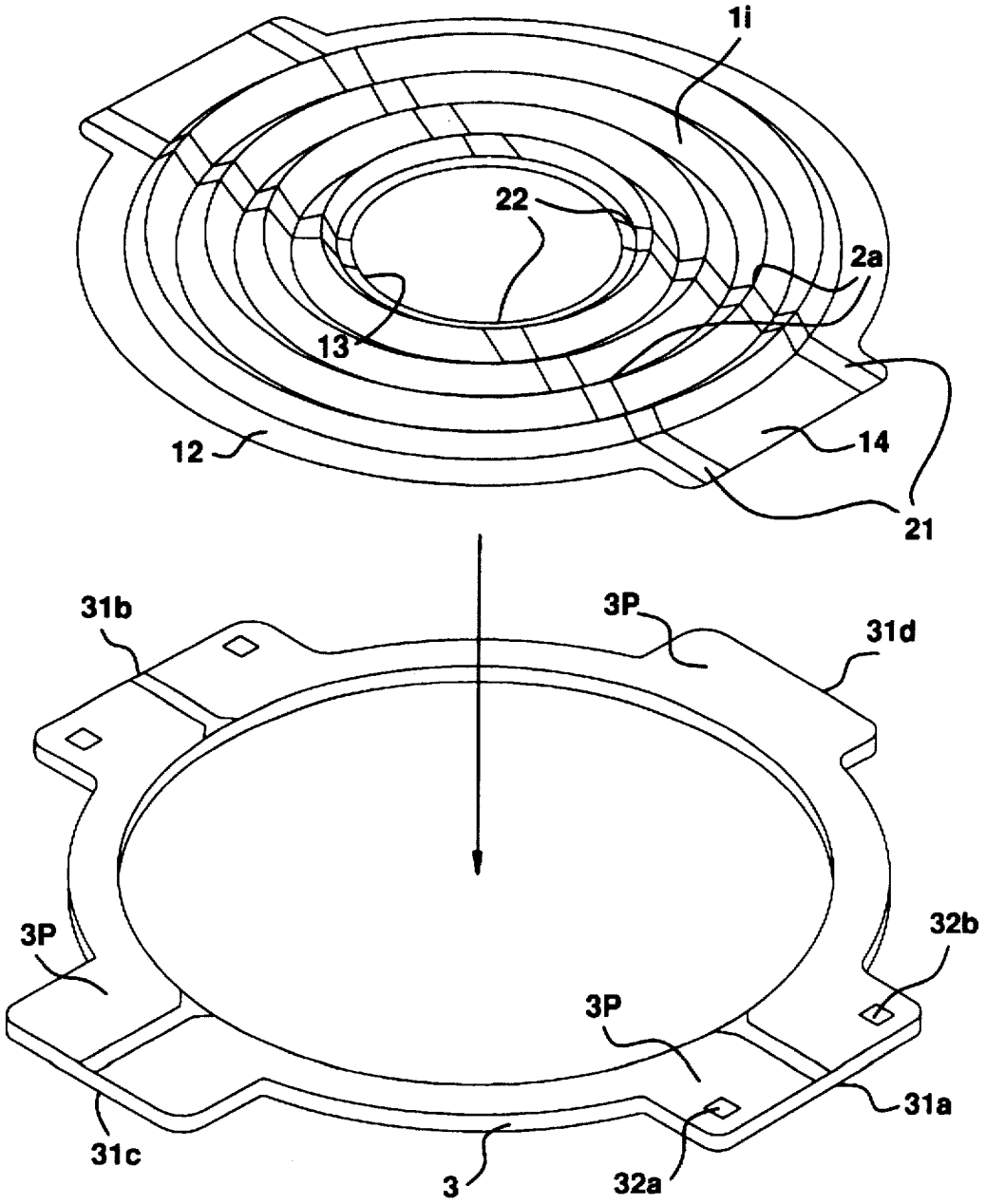
FIG. 11 is a perspective view of a damper with a conductive member and a terminal ring before they are assembled according to a fourth embodiment of the invention.
Figure 12:
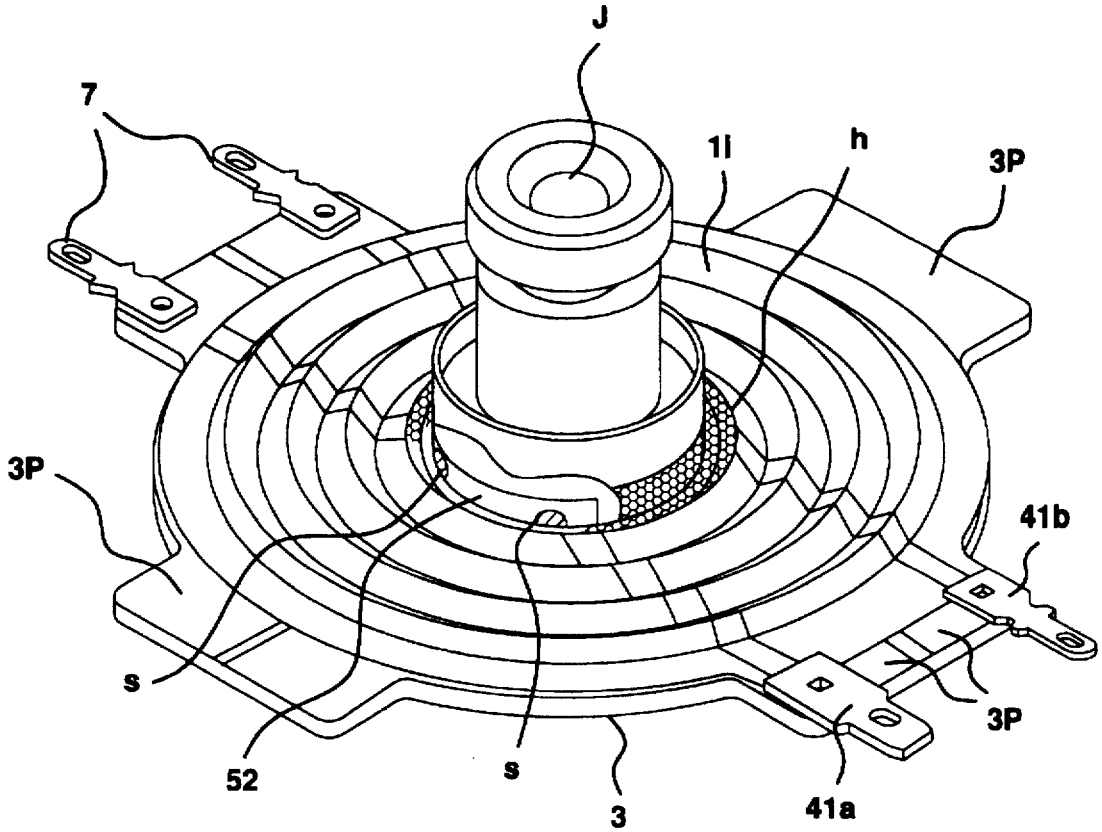
FIG. 12 is a perspective view showing the damper with the conductive member, terminal ring, terminal lugs, and junction terminals respectively mounted and assembled according to the fourth embodiment.
Figure 13:
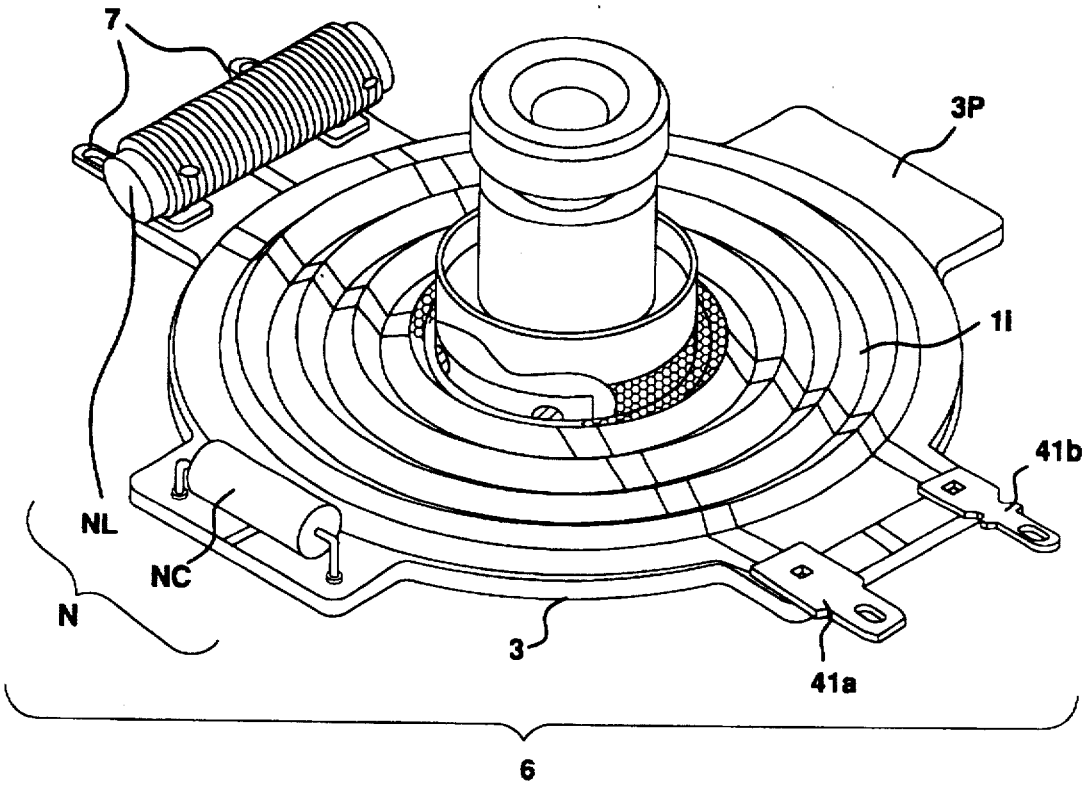
FIG. 13 is a perspective view showing the ring assembly with network components according to the fourth embodiment.
Figure 14:
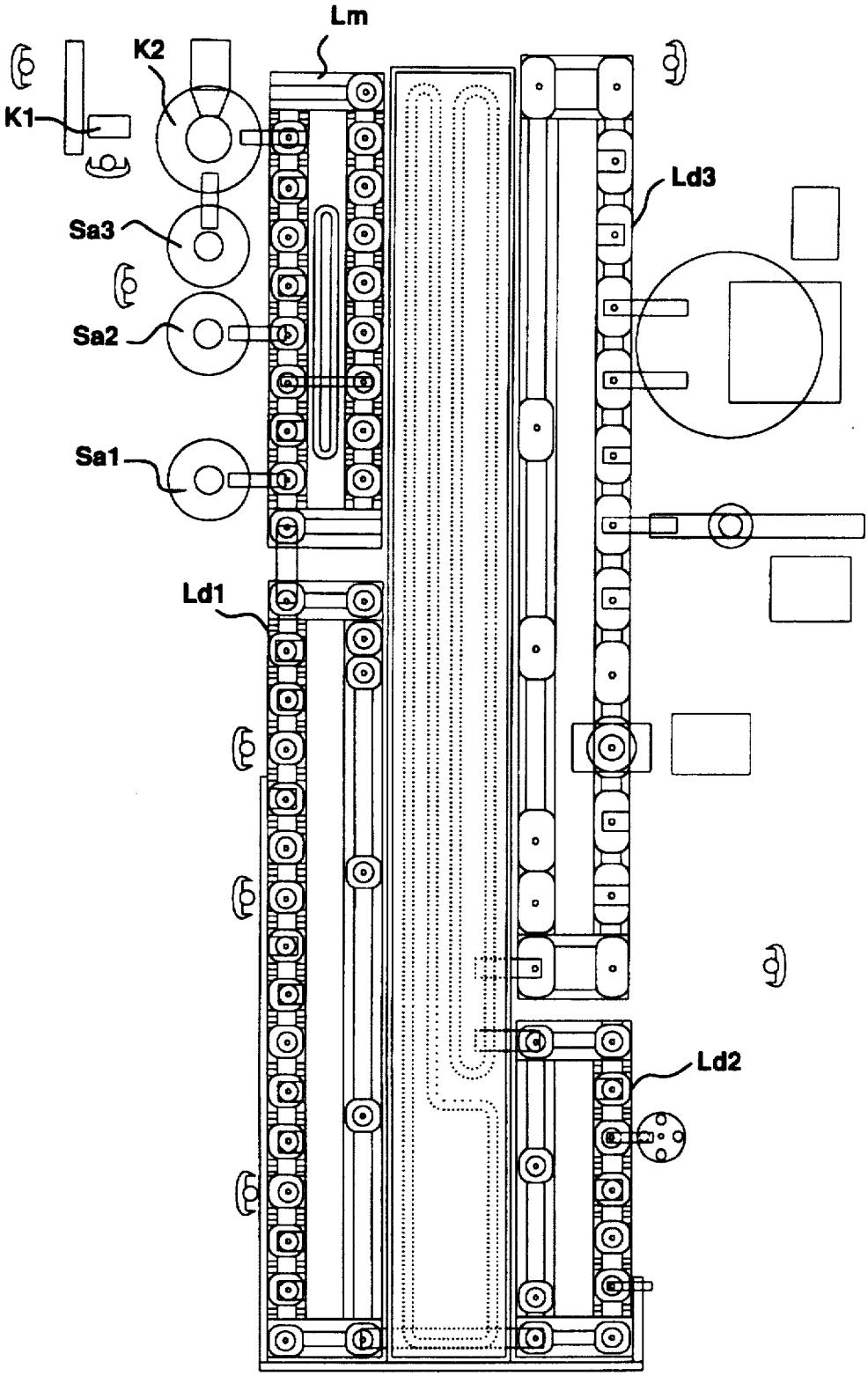
FIG. 14 is a schematic plan view of manufacturing lines according to a conventional first method of manufacturing a speaker with a damper having a conductive member.
Figure 15:
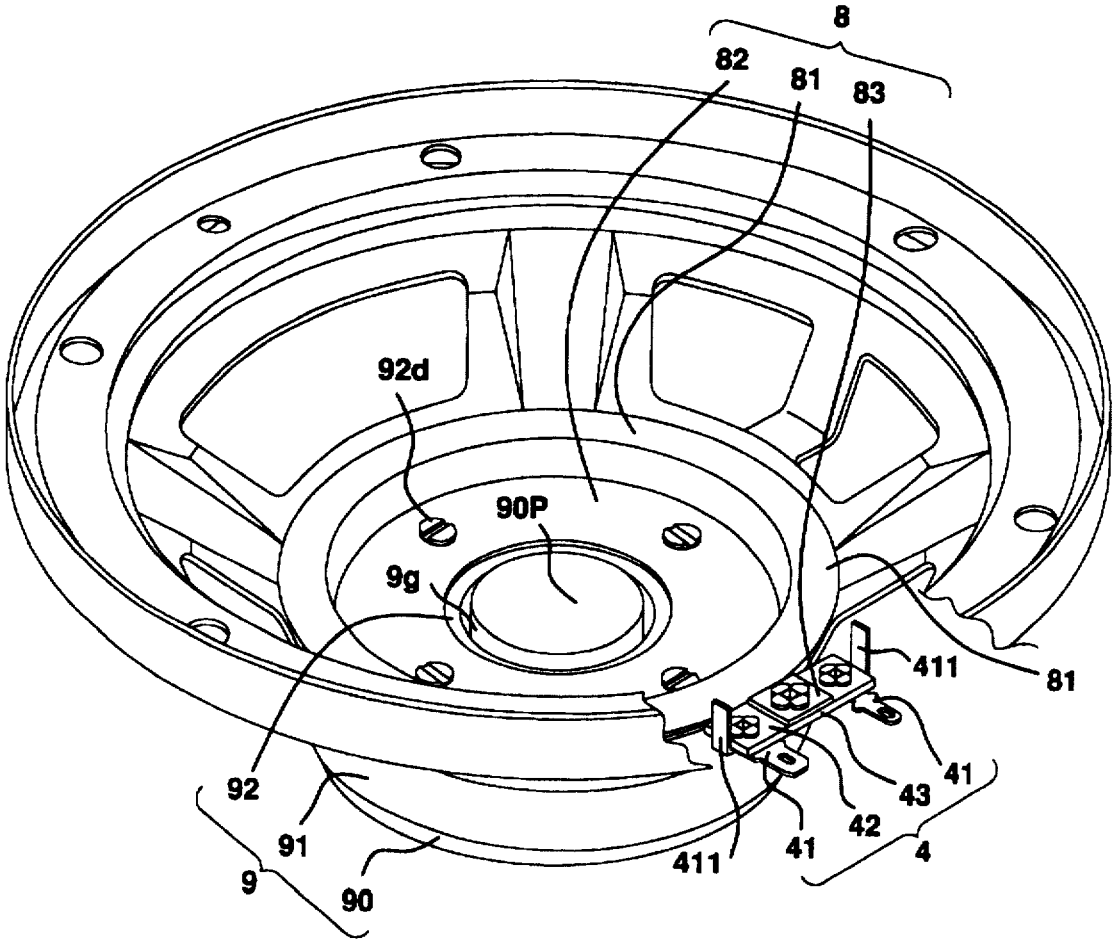
FIG. 15 is a perspective view of a frame having a magnetic circuit and terminals of a conventional speaker with a damper having a conductive member.
Figure 16:
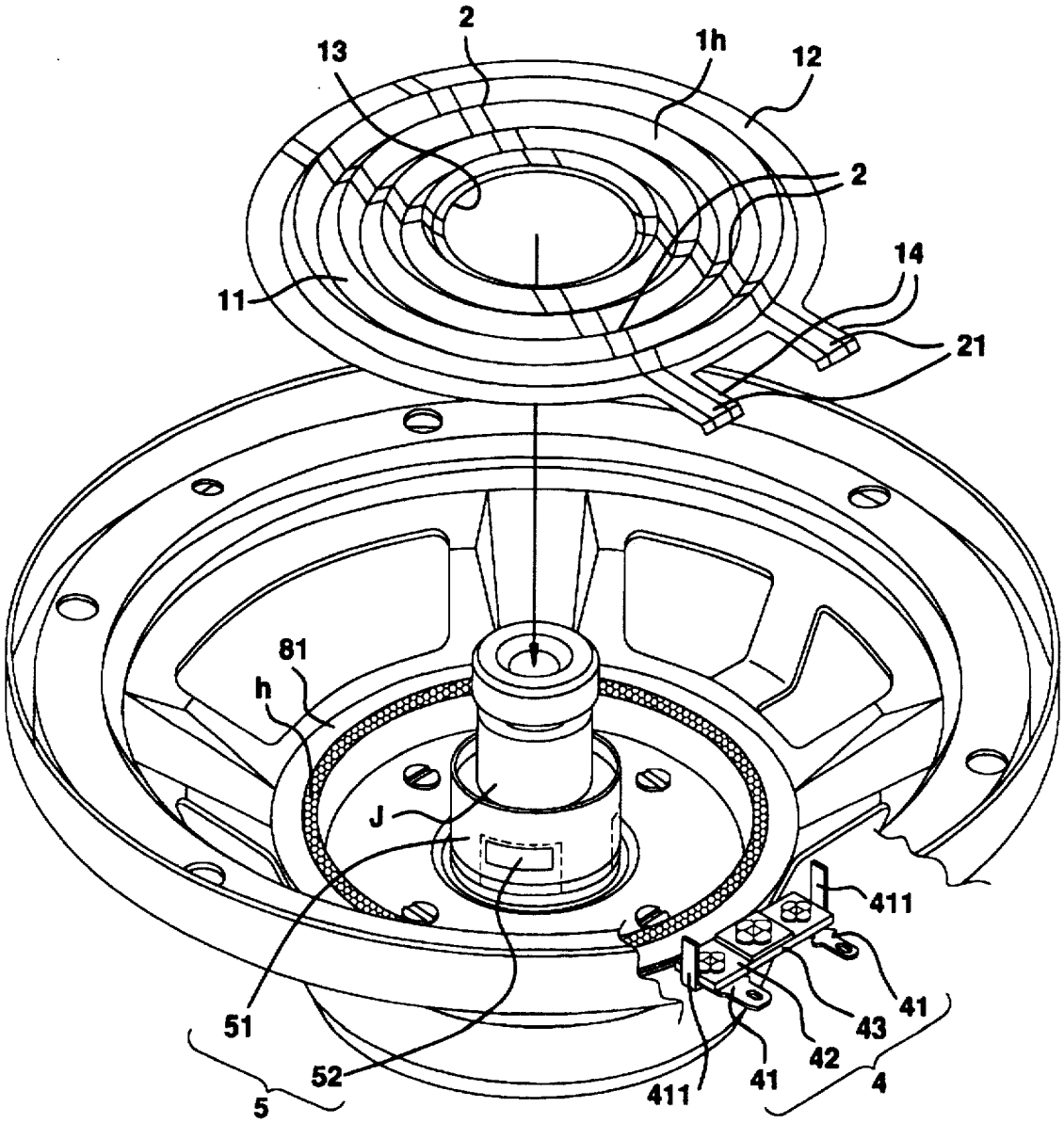
FIG. 16 is a perspective view showing a state immediately before the damper with the conductive member is mounted on a speaker frame by the conventional first manufacturing method.
Figure 17:
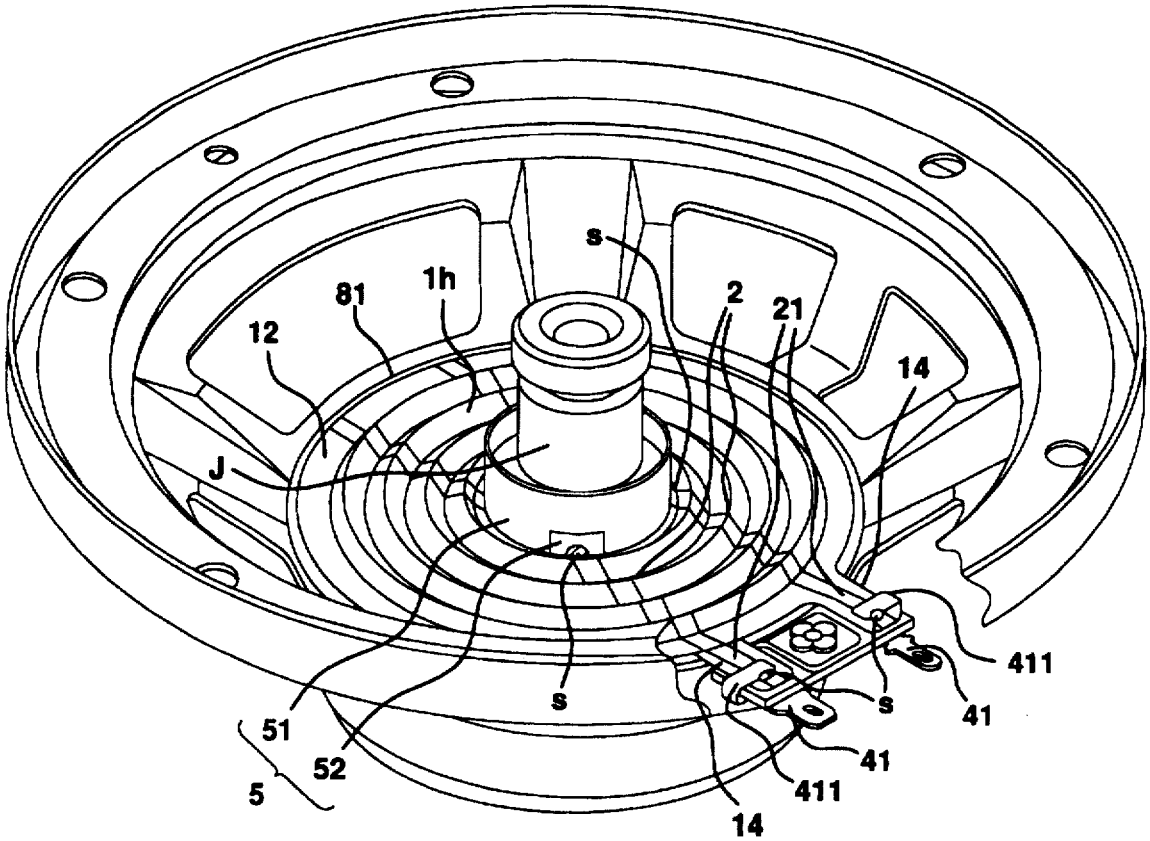
FIG. 17 is a perspective view showing a state wherein after the damper with the conductive member is mounted on a speaker frame by the conventional first manufacturing method, the terminal lugs are bent to the flat knitted tinsel wires and the contact portions between the end portions of the flat knitted tinsel wires and the copper foil electrodes of the coil bobbin and the terminal lugs are soldered.
Figure 18:
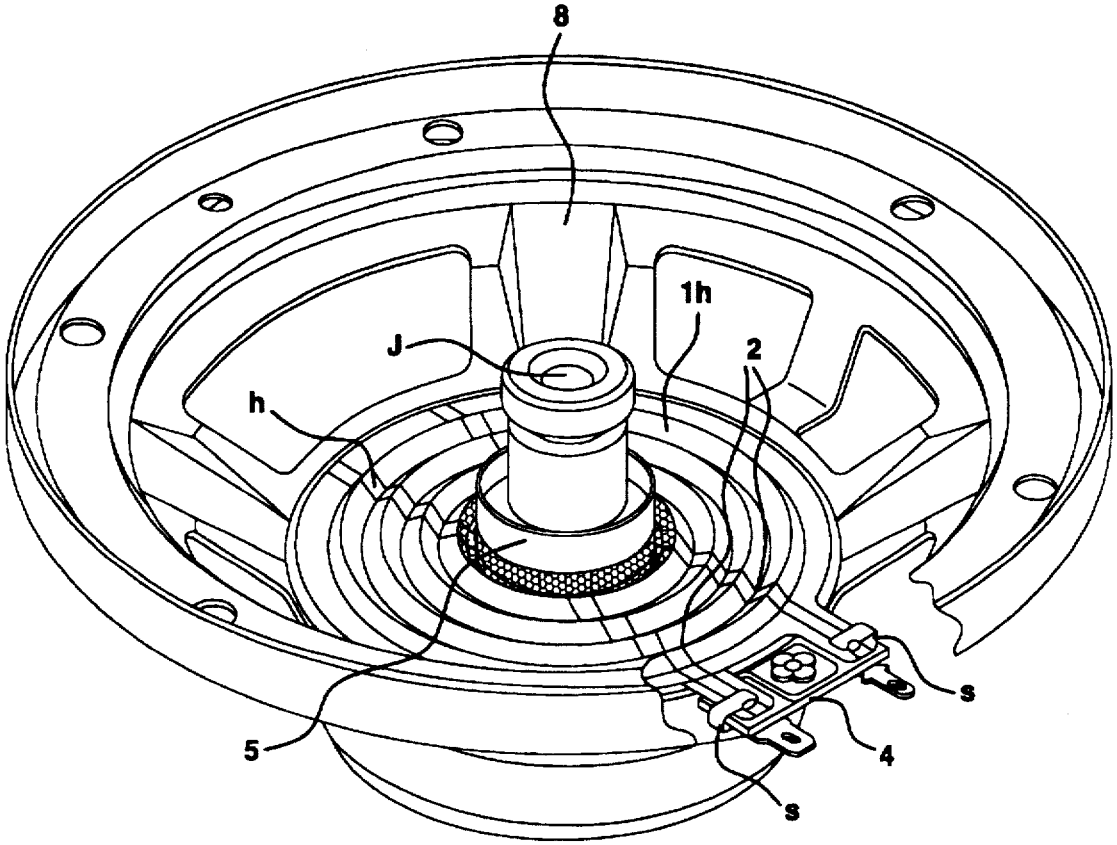
FIG. 18 is a perspective view showing a state wherein after the damper with the conductive member is mounted on a speaker frame by the conventional first manufacturing method, the adhered area between the coil bobbin and damper is coated with adhesive.
Figure 19:
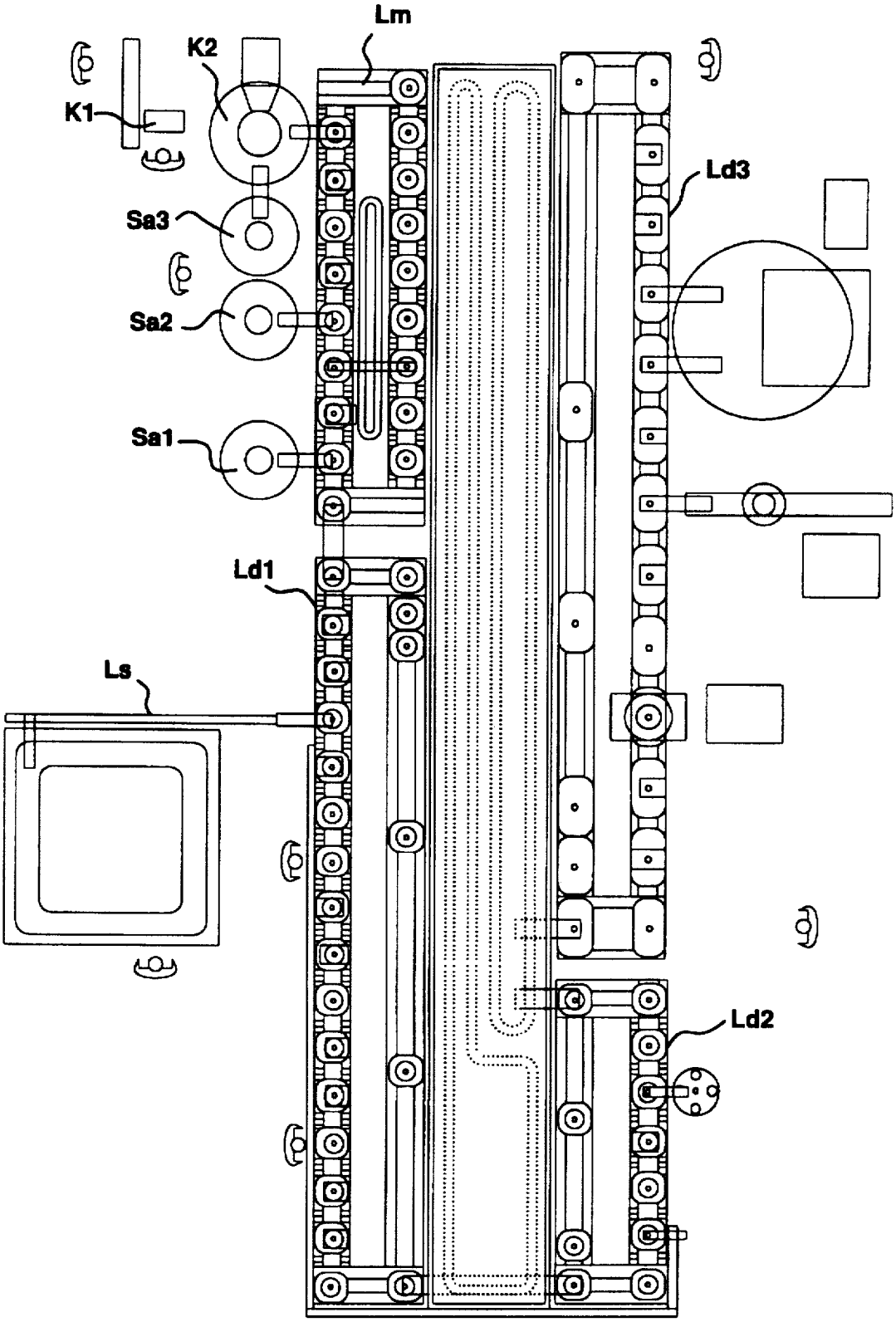
FIG. 19 is a schematic plan view of manufacturing lines according to a conventional second method of manufacturing a speaker with a damper having a conductive member.
Figure 20:
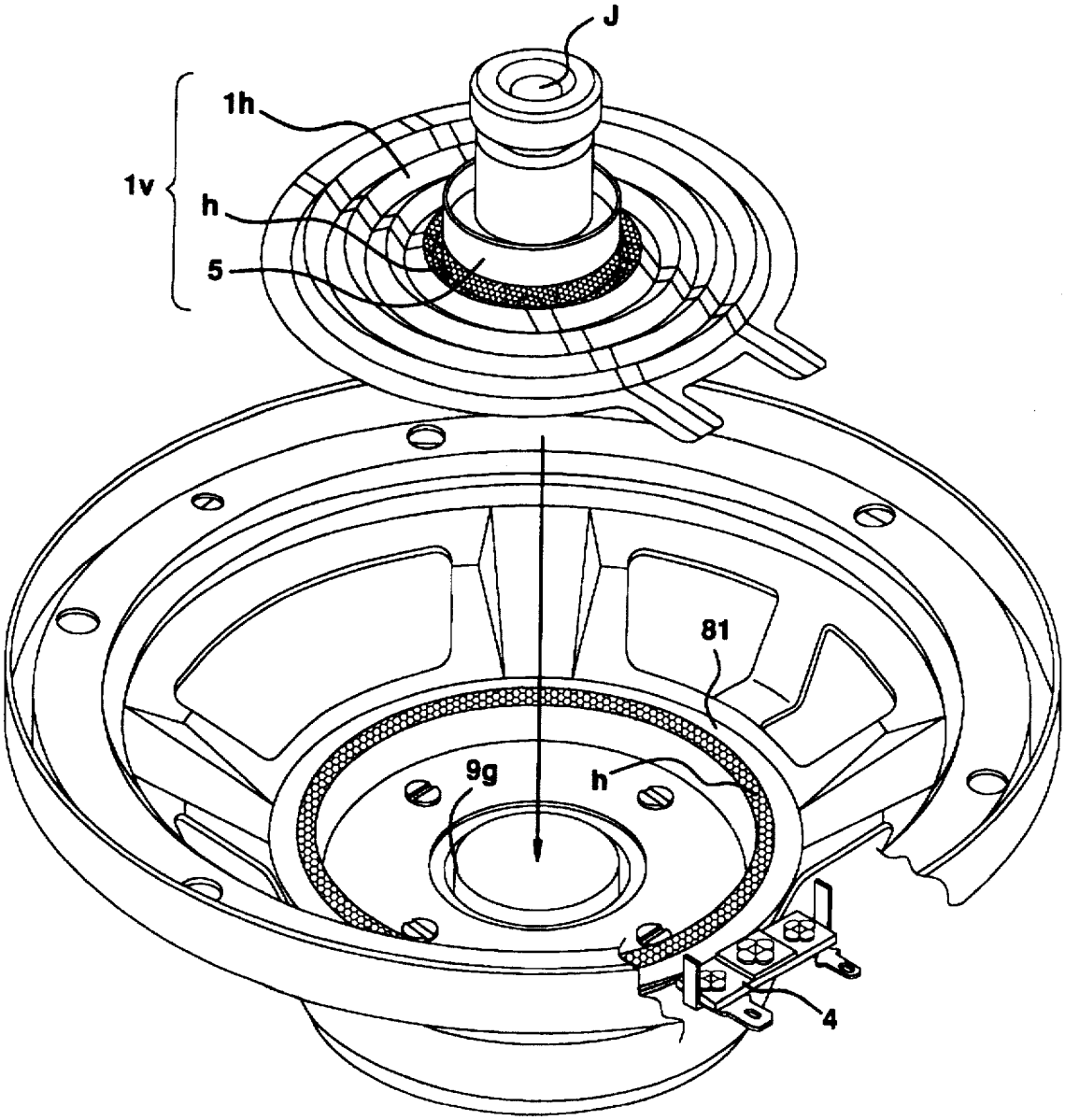
FIG. 20 is a perspective view showing a state immediately before the damper with the conductive member is mounted on a speaker frame by the conventional second manufacturing method.
Figure 21A:
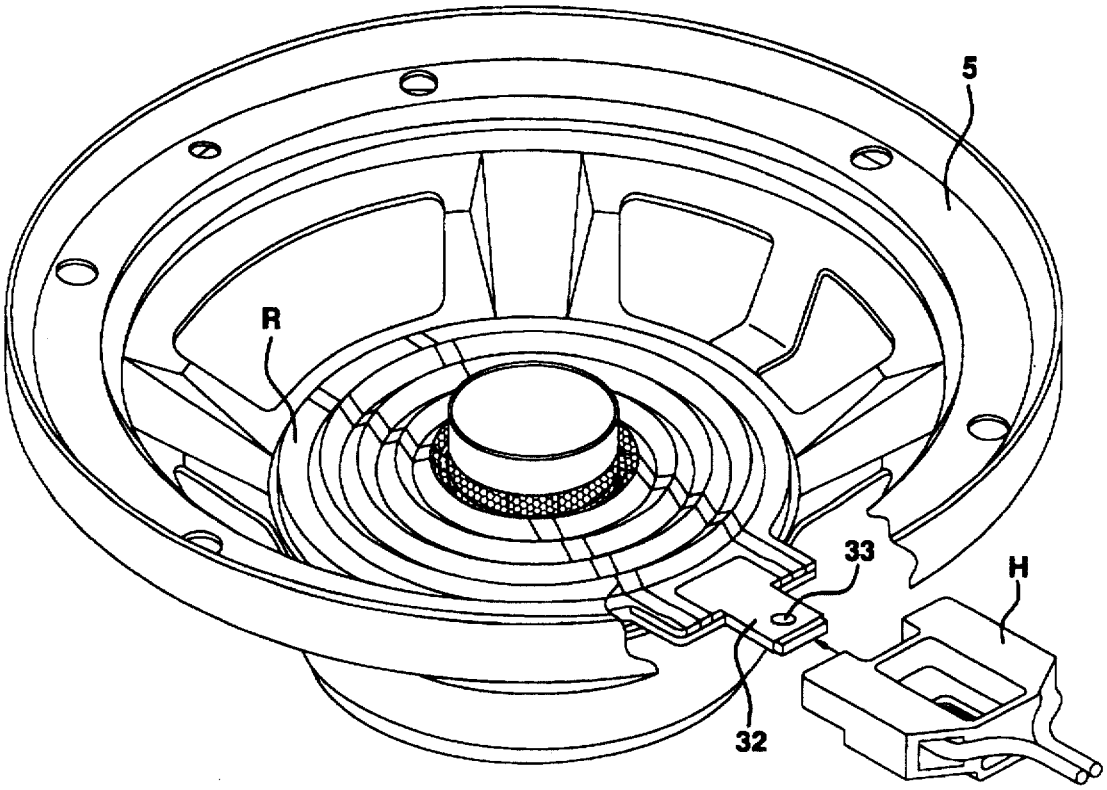
FIG. 21 is a perspective view of a speaker interconnection structure having an improved connector in accordance with a fifth embodiment of the present invention.
Figure 21B:
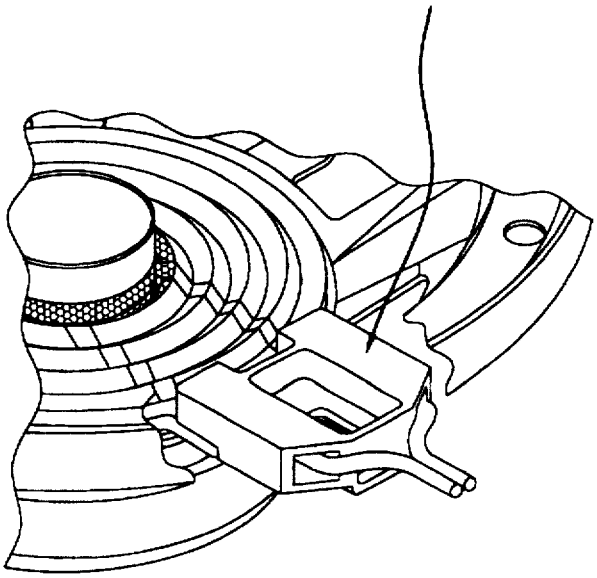

In the fourth embodiment, four tongues 31*a*, 31*b*, 31*c*, and 31*d* are formed on a terminal ring 3 as shown in FIG. 11. The conductive pattern is different from the second and third embodiments. A ring assembly 6 is formed by the processes similar to the second embodiment. In this embodiment, as shown in FIG. 12, junction terminals 7 are formed on the tongue 31*b* of the terminal ring 3 opposite to the tongue 31*a* for mounting input terminal lugs. As tweeter network components, a capacitor NC is mounted on the tongue 31*c*, and a choke coil NL is mounted on the junction terminals 7. The network components N and junction terminals 7 are electrically connected to a predetermined pattern 3P. In this manner, a ring assembly 6 with the network components N is completed. The succeeding processes similar to the second embodiment are performed to manufacture a speaker. This speaker is used as a speaker for low frequency sounds (hereinafter called a woofer). A speaker for high frequency sounds (hereinafter called a tweeter) is mounted on a support formed on the top surface of a yoke 90 as the magnetic circuit component of the woofer. In this manner, a coaxial type speaker is manufactured in which the tweeter is disposed in front of the woofer near at the central axis of the diaphragm of the woofer.

In this embodiment, lead wires are extended from the junction terminals 7 of the ring assembly 6 to the input terminal lugs of the tweeter via a hole 90*a* of the yoke 90. If the junction terminals 7 are not provided, the wiring connection to the tweeter may be performed by connecting together a conductive pattern 3P such as a copper foil of the coil bobbin 51, a conductive area such as a copper foil on the cone paper sheet, and a conductive area of a flat knitted tinsel wire 2 on a dust-proof damper, as previously proposed by the present inventors. The assembly jig of this embodiment is not shown because the drawings become too complicated and hard to understand. Furthermore, although the position of adhesive for adhering the ring 3 and damper 1 with the conductive member is not shown in the second to fourth embodiments, the position is basically the same as the first embodiment.

In the above embodiments, the voice coil 5, damper 1 with the conductive member, and terminal ring 3 are integrally assembled, and the end portions 21 and 22 of the flat knitted tinsel wires 2 of the damper 1 with the conductive member, the electrodes 52 of the coil bobbin 51, and the terminal lugs 41 of the terminal ring 3 are wired. At this time, the wiring connection necessary for a speaker is completed so that conduction and resistance can be checked. After the coil bobbin 51 and the damper 1 with the conductive member are adhered together by using adhesive or the like, the ring assembly 6 is formed as one complete component. This ring assembly 6 is mounted on a predetermined magnetic circuit block. In this state, a polarity can be checked by flowing current via the input terminal lugs 41. The Fo of the ring assembly can be measured by applying an electrical signal having a predetermined voltage in a desired range of frequency. In this manner, a dynamic compliance of the damper 1 with the conductive member including the voice coil 5 can be measured.

It is therefore possible to check the wiring before the ring assembly is supplied to the manufacturing main line Ld1. A defective speaker can be easily repaired. Manufacturing yield is considerably improved as compared to a conventional manufacturing method which checks the performance of a speaker at the final manufacturing step.

The dynamic compliance can be measured easily before the ring assembly is supplied to the manufacturing main line, and also the measurement can be performed in very short time as compared to a conventional test method. Therefore, it is possible to manufacture speakers after all ring assemblies 6 are tested before they are supplied to the manufacturing main line, for example, after all ring assemblies 6 are tested at a different position from the manufacturing main line or at the sub-line Ls.

It is therefore possible to stabilize the Fo of speakers or suppress the variation of Fo in a small range. The quality of each speaker can be improved further.

By mounting the junction terminal lugs 7 on the terminal ring 3, the wiring structure of a two-way speaker or the like, particularly a coaxial type speaker, can be simplified so that a wiring work is very easy. In the speaker structure, for example, the second embodiment shown in FIGS.8 and 9, the wiring pattern 3P formed on the terminal ring 3 and the end portions 21 of the flat knitted tinsel wires extending to the outer circumference of the damper 1 with the conductive member, or the wiring pattern 3P formed on the terminal ring 3 and the input terminal lugs 41 or the like, are electrically connected where necessary. In this case, in addition to the wiring connection between the flat knitted tinsel wire 2*a* on the input terminal lug side and the input terminal lugs 41*a* and 41*b* as in the case of the first embodiment, the flat knitted tinsel wire 2*b* disposed on the side opposite to the input terminal lugs 41*a* and 41*b* are wired. Therefore, the flat knitted tinsel wire 2*b* which conventionally gives only a balance function of compliance can provide its essential conduction function. Since the number of tinsel wires dedicated to conduction increases, the input capacity of the flat knitted tinsel wire 2 can be doubled without changing the compliance of the damper 1.

In the third embodiment, a single flat knitted tinsel wire 2 is disposed along the damper center line. The labor cost of loading the flat knitted tinsel wire 2 can be halved. Further, the influence of compliance by the flat knitted tinsel wire 2 can be minimized while mounting the input terminal 4 at the same positions as the conventional positions. In the fourth embodiment, the network components N such as the capacitor NC and choke coil NL are mounted on the terminal ring 3, and are electrically connected, where necessary, to the wiring pattern 3P, flat knitted tinsel wires 2, input terminal lugs 41, junction terminal lugs 7, and the like. It is therefore possible to manufacture the ring assembly 6 mounted with the network components N. A coaxial type speaker can be manufactured easily. The number of assembly processes reduces considerably. Since the network components N can be mounted in the space defined by the outer size of a mount flange of the speaker frame 8, the speaker becomes very compact. This structure is very effective for a vehicle mount coaxial type speaker whose space factor is very important.

Although not described in the above embodiments, the second and fourth embodiments may be combined. This wiring method is very effective for a speaker having a so-called double voice coil having an additional coil over the inner coil or at least a plurality of coils. For example, input terminal lugs are mounted on the junction terminal side and connected to the flat knitted tinsel wires **2*b*. Copper foil electrodes 52 corresponding in number to the number of additional coils are attached to the coil bobbin 51 of the voice coil 5 and soldered to the flat knitted tinsel wires extending to the damper inner hole 13**. In this manner, conventional very complicate wiring of a speaker having a double voice coil can be simplified considerably and the number of wiring processes can be halved.

When the wiring of the ring assembly 6 with the network components N is completed, or when the ring assembly 6 is completed by coating adhesive h to the adherence portion between the voice coil 5 and damper 1 with the conductive member and the adhesive h takes a predetermined strength, a test of conduction, polarity, and performance of the network components is performed and thereafter, the ring assembly is supplied to the speaker manufacturing line to complete a speaker. It is therefore possible to test in advance at least the network components including a woofer. This test can be automated so that man power can be reduced. As a result, a manufacturing yield, productivity, and quality of a speaker with the network components can be improved.

In the method of assembling the terminal ring 3 and damper 1 with the conductive member as in the case of the second embodiment, the terminal ring 3 is formed with a conductive area and adhesive h is coated on the adhesive margin of the terminal ring 3, i.e., in this embodiment, mainly on the inner circumferential portion of the terminal ring 3, or on the adhesive margin 12 of the damper 1 with the conductive member. Thereafter, cream solder sc is coated on the predetermined area of the conductive area of the terminal ring 3 or on the predetermined area near the end portions 21 of the flat knitted tinsel wires of the damper 1 with the conductive member. The outer circumferential portions of the terminal ring 3 and the damper 1 with the conductive member including the damper adhesive margin 12 are thermally pressed to thermally reactivate the adhesive and adhere the terminal ring 3 to the adhesive margin 12 and at the same time to melt the cream solder sc to solder the end portions 21 of the flat knitted tinsel wires to the conductive areas of the terminal ring 3. It is therefore possible to adhere the terminal ring 3 to the damper 1 with the conductive member and at the same time to solder the conductive areas of the terminal ring 3 to the end portions 21 of the flat knitted tinsel wires. The process time can therefore be shortened. In this embodiment, although the conductive area is the conductive pattern 3P made of copper foil or the like, cream solder sc may be coated on the input terminal lugs 41 mounted before thermal pressing, and the end portions 21 of the flat knitted tinsel wires are soldered.

The terminal ring 3 can be designed as desired by changing the molding die or the like. Therefore, a conventional speaker frame 8 itself can be used. Even if network components N are mounted as in the fourth embodiment, a change in the frame 8 can be minimized. The structure of the speaker of this invention is fundamentally suitable for application to a conventional manufacturing process so that a cost required for modification is small and the degree of design freedom is large.

According to the method of manufacturing a speaker of this invention, a damper with a conductive material is made of a woven cloth having a flat knitted tinsel wire sewn or woven. A terminal ring made of insulating material such as resin is mounted on the damper at its adhesive margin. Input terminal lugs are mounted on the terminal ring. A voice coil for driving a diaphragm such as a cone paper sheet is mounted on the damper with the conductive member and input terminal lugs. Copper foil electrodes on the outer circumference of a coil bobbin of the voice coil and the end portions of the flat knitted tinsel wires extending to the inner hole of the damper with the conductive member are electrically connected, and the terminal lugs and the end portions of the flat knitted tinsel wires extending to the outer circumference of the damper with the conductive member are also electrically connected. The coupling area between the damper with the conductive member and the voice coil or coil bobbin is adhered by adhesive to obtain a ring assembly. This ring assembly is supplied to a speaker manufacturing main line to assemble a speaker. The invention has therefore the following advantages.

As compared with a conventional speaker frame mounted with an input terminal, the structure of the terminal ring mounted on the damper with the conductive member is very simple and light in weight. Therefore, automatic mount of the input terminal lugs becomes easy.

The terminal lugs can be mounted by applying a conventional mount technique such as caulking and a reliable mount strength is ensured. The terminal lug mount apparatus may be small. Parts of the terminal lugs are pressed against the end portions of the flat knitted tinsel wires with a very strong force, so that the quality of wiring connection can be improved.

A speaker manufactured by the method of this invention has as a main constituent element a ring assembly with completed wiring connections. Accordingly, automatic mount of terminal lugs is easy and the assembly is very simple.

An embodiment of a speaker interconnection structure of the invention which is further improved to have a connector, will be described with reference to FIGS. 21 to 29.

A damper 1 with a conductive member is basically similar to the damper with a conductive member proposed by the present inventors. A damper cotton cloth is dipped in solution diluted with phenol and methanol of about 1:4.5, and is impregnated with phenol resin. After the solvent is evaporated to remove a tack nature of the resin, the cloth is cut to have a predetermined width. This cloth is used as the material of the damper 1 with a conductive member.

A tin-copper alloy wire having a bus bar diameter of 0.1 mm is worked to a foil having a width of 0.32 mm and a thickness of 0.027 mm, and the foil is wound in a single layer at 22+/−2 turns/cm around a paraaramid fiber of 200 denier to form a tinsel wire. A bundle of 13 tinsel wires is knitted flat at a knitting pitch of 27.45+/−0.82 mm/turn to form a flat knitted tinsel wire 2 having a width of about 2.2 mm, a thickness of 0.44 mm, and an electric resistance of 0.48 Ω/M. Two flat knitted tinsel wires 2 are sewn in parallel on the damper 1 at the positions spaced by 10.5 mm (a pitch of about 21 mm) from the center of the width of the cut woven cloth of the damper 1, by using a thread called cornex #40. The damper is then thermally molded to form a plurality of concentric corrugations 11 with the flat knitted tinsel wires 2 traversing the corrugations 11.

Figure 22:
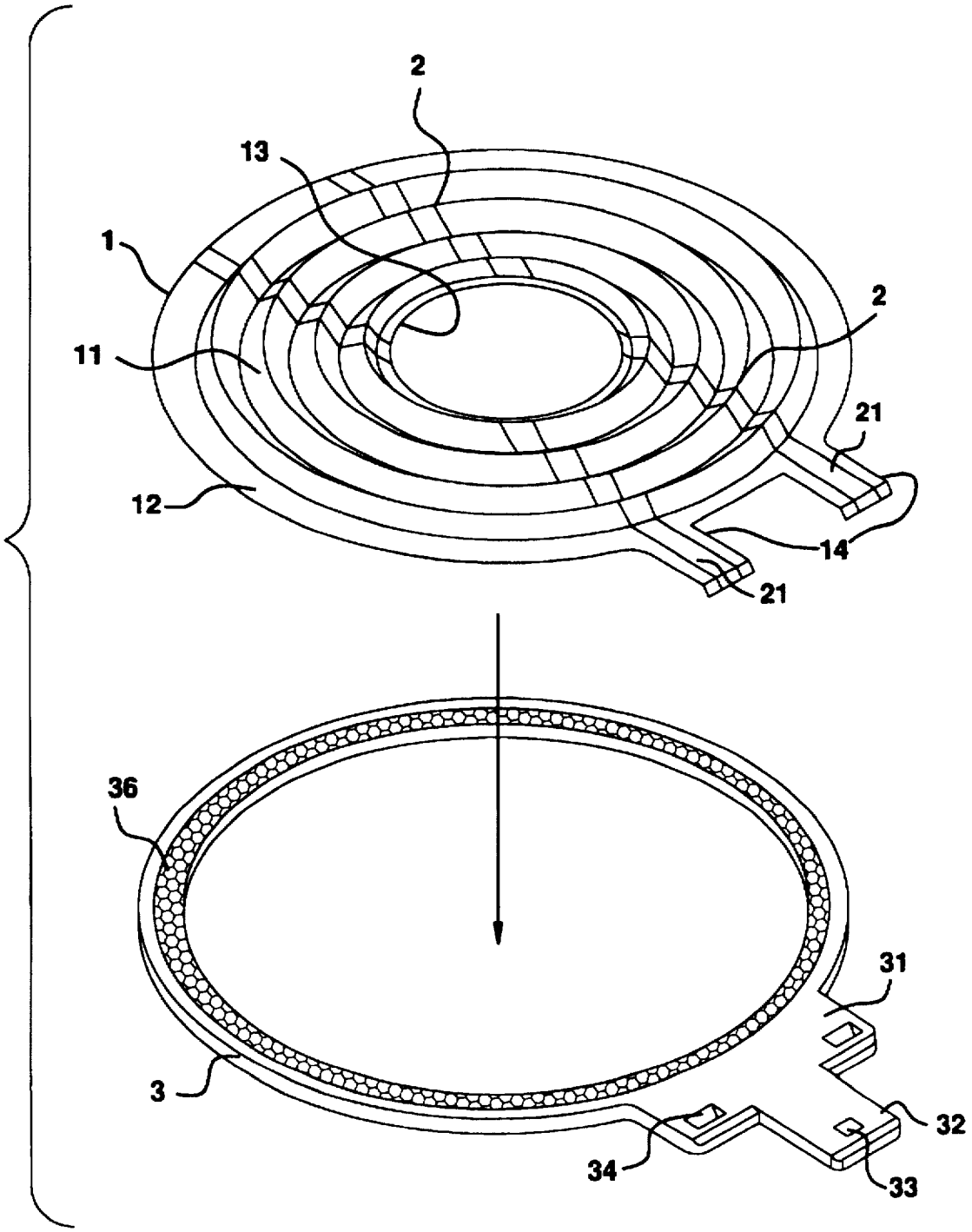
FIG. 22 is a perspective view of a damper with a conductive member and a terminal ring before the assembly, illustrating a method of manufacturing a speaker according to fifth embodiment of the invention.

After the thermal molding, unnecessary portions are removed by a punching press machine to obtain a damper 1 having a predetermined shape, with the flat knitted tinsel wires 2 being sewn as shown in FIG. 22. The outer diameter of the damper 1 is 78 mm, and the inner diameter of an opening at the junction 13 to a coil bobbin is 26.3 mm. Seven corrugations 11 of about 2.4 mm deep are disposed at a pitch of about 2.8 mm from the area near the opening, and an adhesive margin 12 of about 4 mm wide is formed at the outer peripheral portion. Two tongues 14 are formed in parallel outside of the adhesive margin 12 at the positions spaced by an equal distance from the center of the damper, the tongue 14 being 29 mm wide and 7.7 mm long. The flat knitted tinsel wires 21 extend to the tongue 14. The flat knitted tinsel wires 2 become about 3 mm wide after the press molding.

A terminal ring 3 made of insulating material such as resin is used, similar to Japanese Patent Laid-open Publication NO.6-337496 proposed by the present inventors. The terminal ring 3 has an inner diameter of 69.6 mm and an outer diameter of 79.2 mm. A tongue 31 having a width of 29.3 mm and a length of 8.3 mm such as shown in FIG. 22 is formed at the outer peripheral portion of the ring. Recesses 34 are formed in the tongue 31 at the width center thereof symmetrically with the center line of the ring at a pitch of 21 mm same as that of the flat knitted tinsel wires 2 sewn on the damper 1. The positions of the recesses 34 correspond to the ends of the flat knitted tinsel wires 2. The side walls of the recesses 34 are tapered so that terminal lugs 42 can enter the square holes 34 easily.

A projected mount 32 for mounting a connector housing 41 extends outward from the tongue 31 along its center line. The projected mount 32 is 11.2 mm wide and 10 mm long. The distal end of the projected mount 32 is tapered so as to make it easy to insert the connector housing 41. A square hole 33 having a side length of 3.6 mm is formed at the position 5 mm inside the distal end along the center line of the terminal ring 3. The thickness of the terminal ring 3 is 2 mm, and in this embodiment, it is made of ABS resin.

Rubber-based adhesive 36 is coated on the inner circumferential portion of the terminal ring 3 by a predetermined amount, and dried for a predetermined time to volatilize solvent of the adhesive. Thereafter, the terminal ring 3 is aligned with the adhesive margin 12 of the damper 1, and the tongue 14 of the damper 1 and the tongue 31 of the terminal ring 3 are aligned in position. The adhesive 36 is thermally reactivated by thermally pressing the adhesive margin 12 of the damper 1 to secure the terminal ring 3 to the adhesive margin 12. After the damper 1 and terminal ring 3 are adhered together, a voice coil 7 and the damper 1 with the terminal ring 3 are set on a setting jig 74, and the outer circumference of a coil bobbin 71 is inserted into the inner hole 13 of the damper 1 to assemble them.

Figure 23:
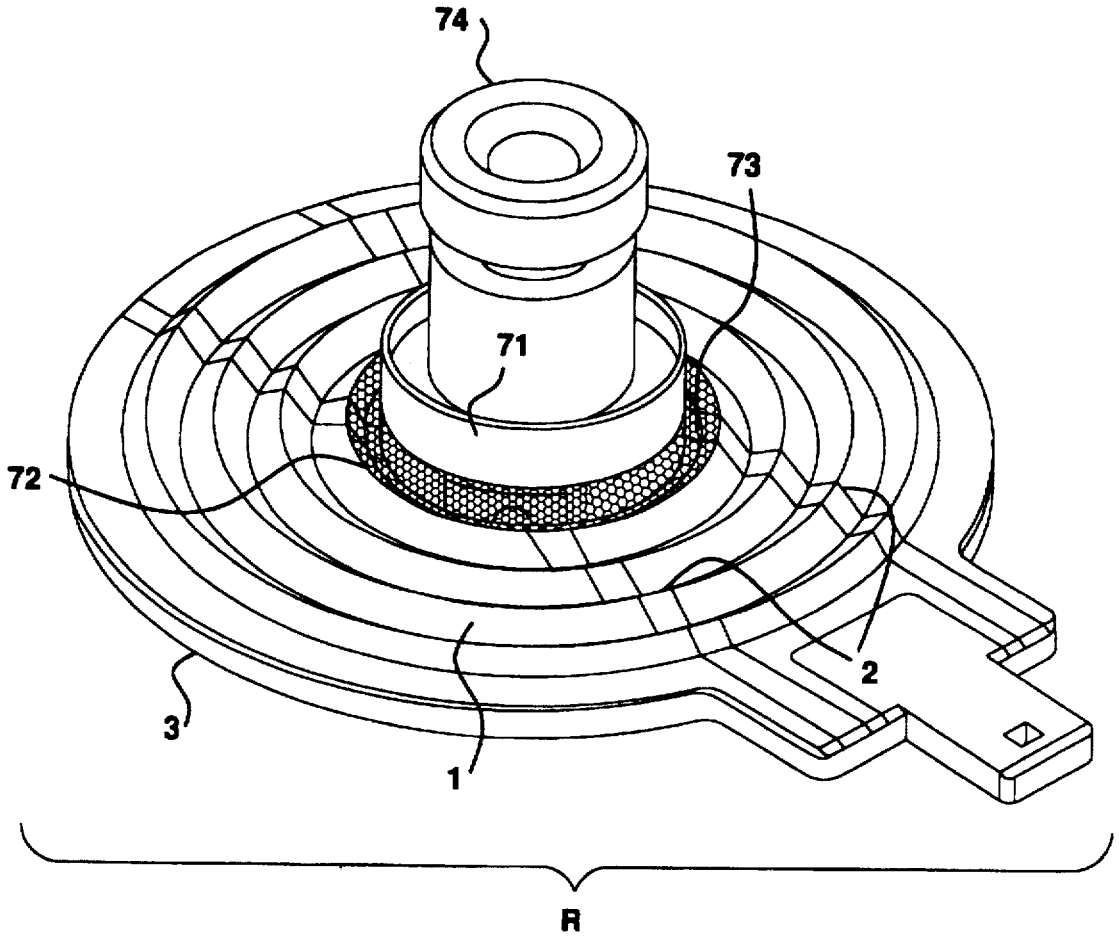
FIG. 23 is a perspective view of a ring assembly formed by assembling a damper with a conductive member, a terminal ring, terminal lugs, and voice coil, wiring them, and adhering the coil bobbin to the damper.

Two copper foil input electrodes 72 are attached to the outer circumference of the coil bobbin 71 at the predetermined positions corresponding to the flat knitted tinsel wires 2 of the damper 1. The coil bobbin 71 is inserted by aligning the copper foil electrodes 72 with the end portions 21 of the flat knitted tinsel wires extending to the inner hole 13 of the damper 1. As shown in FIG. 23, the copper foil electrodes 72 at the outer circumference of the coil bobbin 71 are soldered to the end portions 22 of the flat knitted tinsel wires extending to the inner hole 13 of the damper 1. An assembly jig for this embodiment is not shown because the structure thereof is very complicated and hard to understand.

Figure 24:
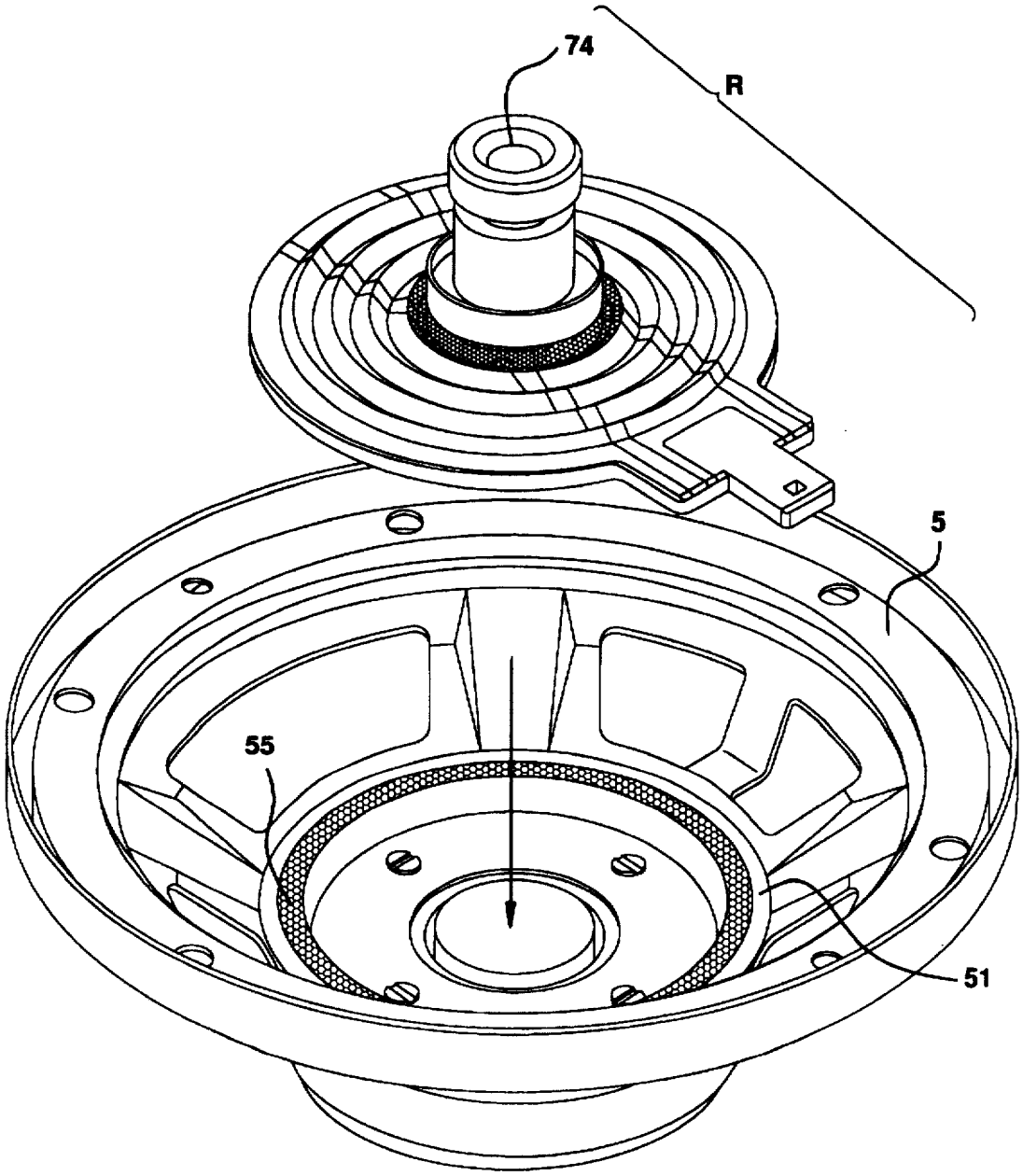
FIG. 24 is a perspective view of a ring assembly immediately before it is assembled as a speaker.

Under these conditions, probes of a tester are made in contact with the end portions 21 of the flat knitted tinsel wires to check any broken wire and a resistance of the coil. Thereafter, similar to a conventional method, adhesive 73 is coated on the whole contact area between the outer circumference of the coil bobbin 71 and the inner hole 13 of the damper 1 to adhere the coil bobbin 71 and the damper 1 and to cover the soldered area of the outer circumference of the bobbin 71, as shown in FIG. 23. After a predetermined adhesion strength is obtained, the bobbin 71 and damper 1 are dismounted from the setting jig to complete a ring assembly R. As shown in FIG. 24, the ring assembly R is mounted on a speaker frame 5 to complete a speaker.

Input lead wires 6 are vinyl parallel wires generally used. A conductor is made of a bundle of 20 metal wires such as copper wires each having a diameter of about 0.18 mm. The conductor is covered with an insulating film (in this embodiment, vinyl chloride resin) to form an insulated conductor having an outer diameter of about 2.6 mm. Two insulated conductors are made in parallel.

Figure 26:
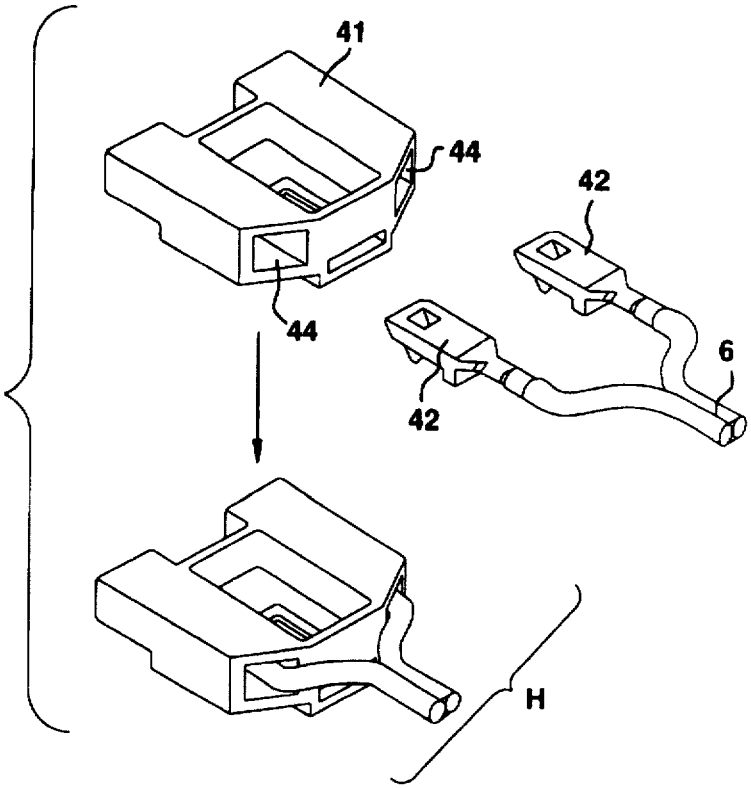
FIG. 26 is a perspective view of connecting terminal lugs with the connector housing in accordance with the fifth embodiment of the invention.

The terminal lug 42 shown in FIG. 26 is formed with a press machine by working a thin plate of metal having a good conductivity such as copper alloy. The end portion of the terminal lug 42 is worked to have a shape shown in FIG. 26 by a press machine through drawing, bending, cutting, and the like.

The insulating film at the end portion 61 of the input lead wire 6 is removed by about 5 mm to expose the conductor. The conductor at the end portion 61 of the input lead wire 6 is caulked at a caulking portion of the terminal lug 42. This caulking method is similar to a conventional fastening terminal connected to the end of an input lead, is widely used, has no problem in its quality, and is highly reliable.

Figure 25A:
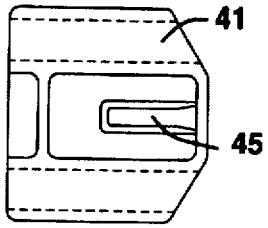
FIG. 25(A) is a top schematic view of a connector housing in accordance with the fifth embodiment of the invention.
Figure 25B:
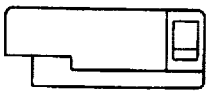
FIG. 25(B) is a side schematic view of the connector housing in accordance with the fifth embodiment of the invention.
Figure 25C:
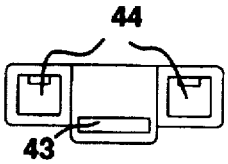
FIG. 25(C) is a front schematic view of the connector housing in accordance with the fifth embodiment of the invention.

The connector housing 41 is made of injection molded resin. As shown in FIGS. 25 and 26, two square holes 44 are formed at the same pitch as the flat knitted tinsel wires 2 of the damper 1, and an opening 43 is formed in correspondence with the projected mount 32 of the terminal ring 3.

Figure 27:
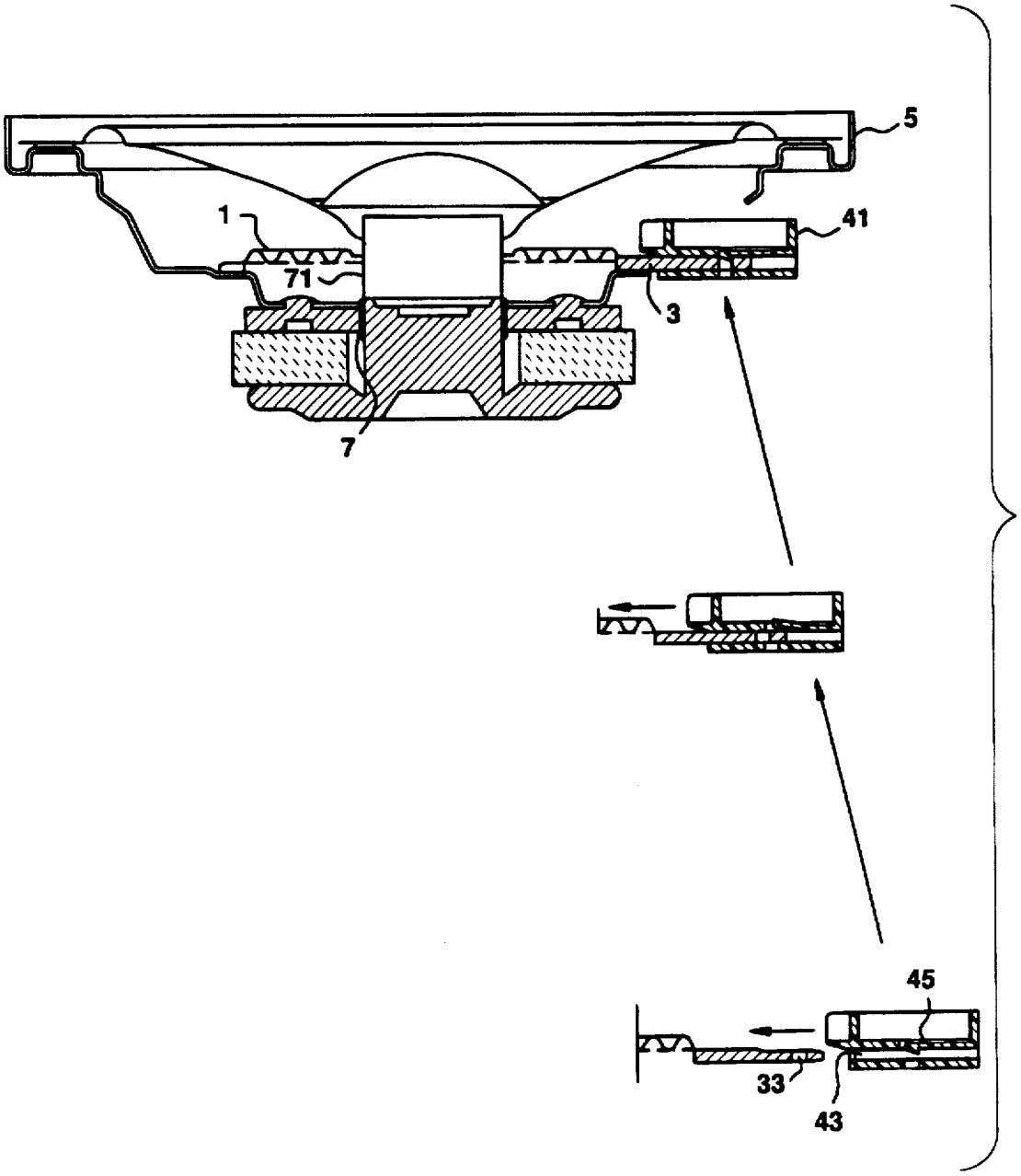
FIG. 27 is a cross-sectional view of the connector housing mounted on the terminal ring in accordance with the fifth embodiment of the invention.

The terminal lugs 42 are fitted in the square holes 44, the front wall of the square hole 44 is aligned with the front (contact) area of the terminal lug 42, and the back wall of the square hole 44 is aligned with the caulked portion of the input lead wire 6. In this manner, the terminal lug 42 at the end portion 61 of the input lead wire 6 is secured by the housing 41 to form a housing H with lead wires. As shown in FIG. 27, the housing H with lead wires is mounted on the terminal ring 3 to complete electrical interconnection.

Figure 28:
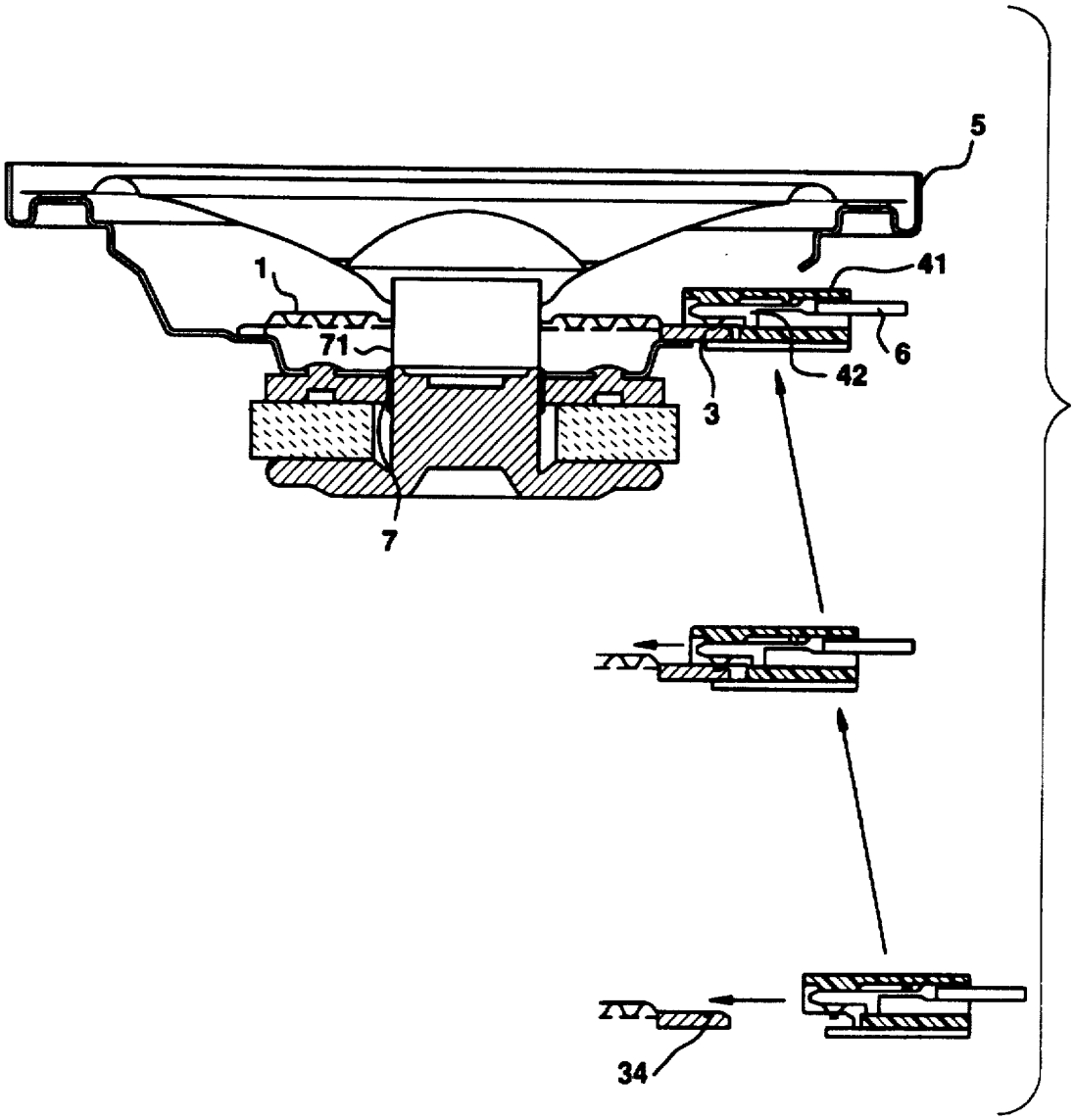
FIG. 28 is cross-sectional view of engaging the terminal lugs with the connector housing that is mounted on the terminal ring in accordance with the fifth embodiment of the present invention.

The projected mount 32 of the terminal ring is inserted into the opening 43 formed near the bottom of the housing H with lead wires. A recess is formed in the wall of the square hole 44 inserted with the terminal lug 42 to expose the front (contact) area of the terminal lug 42. Therefore, as shown in FIG. 28, the front areas of the two terminal lugs 42 become in contact with the two flat knitted tinsel wires 2 extending to the outermost circumference of the damper 1. As the housing H with lead wires is further pushed in, the end portion of the front area of each terminal lug 42 deforms and rides on the tapered portion of the ring terminal 3. As the housing H with lead wires is further pushed in to the final position, the contact area of the terminal lug 42 positions above the recess 34. Therefore, the contact area once deformed restores the original shape by its elasticity and is pressed together with the flat knitted tinsel wire 2 into the recess 34 of the tongue 31 to complete electrical interconnection.

As shown in FIG. 27, a holding member 45 with a hook having an engaging claw is integrally formed on the upper wall of the opening 43 of the housing H with lead wires. The holding member 45 is used for preventing the housing H with lead wires from being dismounted. Therefore, when the housing H with lead wires is pushed in to the final position, the engaging claw of the holding member 45 engages with the square hole 33 of the projecting mount 32 as shown in the cross section of FIG. 27. As a result, the housing H will not be dismounted unless an external force larger than the holding member 45 is applied. By pushing the end of the hook of the holding member 45, the engaging claw can be disengaged from the square hole 33 to release the lock state, and the housing H with lead wires can be dismounted from the projecting mount 32 of the terminal ring 3.

Figure 29A:
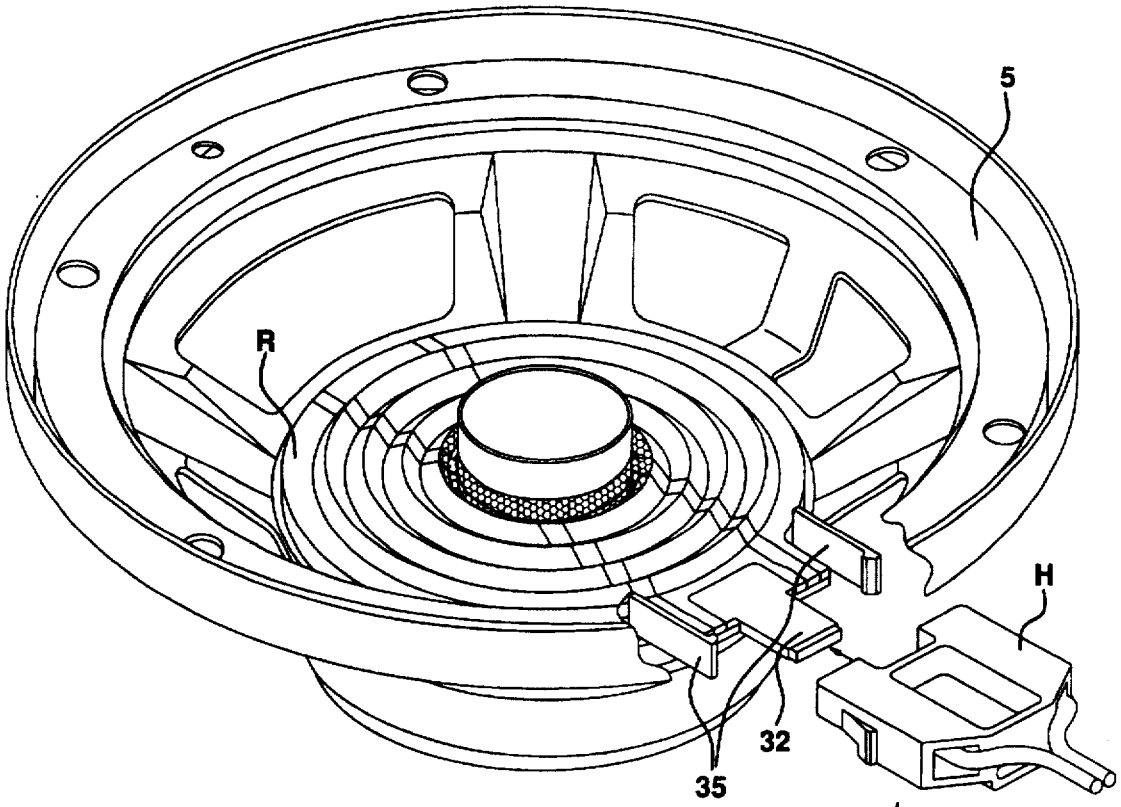
FIG. 29 is a perspective view of a speaker interconnection structure having an improved connector further including a holding member for engaging with the housing in accordance with another embodiment of the present invention
Figure 29B:
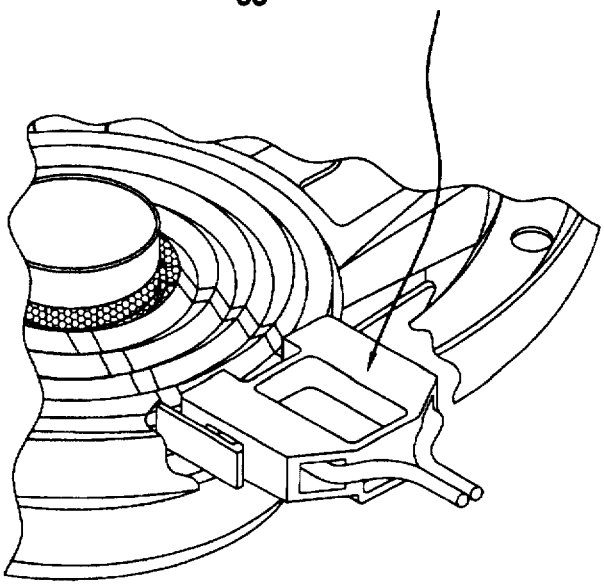

In the above embodiment, the holding member 45 is constructed as above. Since the terminal ring 3 is made of resin, a holding member 35 having a hook such as shown in FIG. 29 may be formed on the projecting mount 32 of the terminal ring 3.

Since the shape of the housing 41 does not match the shape of a conventional speaker frame not using the terminal ring 3, the housing 41 cannot be used presently with a conventional speaker. However, in the future, in accordance with optimization and standardization of the shape of the terminal ring 3 and the shape of a conventional speaker frame 5, the terminal lug 42 and housing 41 can be designed. In this case, connectors can be formed matching both conventional speakers and invention speakers. In the perspective views of the drawings, a diaphragm and other elements are omitted for the simplicity of drawings.

With the structure described above, in the wiring work, when the housing 41 is mounted on the projecting mount 32 of the terminal ring 3, the terminal lug 42 held by the housing becomes in contact with the end portion of the flat knitted tensile wire 2. Therefore, load on finger tips of a worker can be reduced considerably.

As described with reference to FIG. 2, the caulking areas **42*a* and 42*b* of the terminal lugs 41*a* and 41*b* are inserted into the square holes 32*a* and 32*b* of the terminal ring 3** and caulked together. It is possible to dispose a washer type fuse W of a square shape having a square hole at the center thereof when the terminal lug is caulked.

Figure 30:
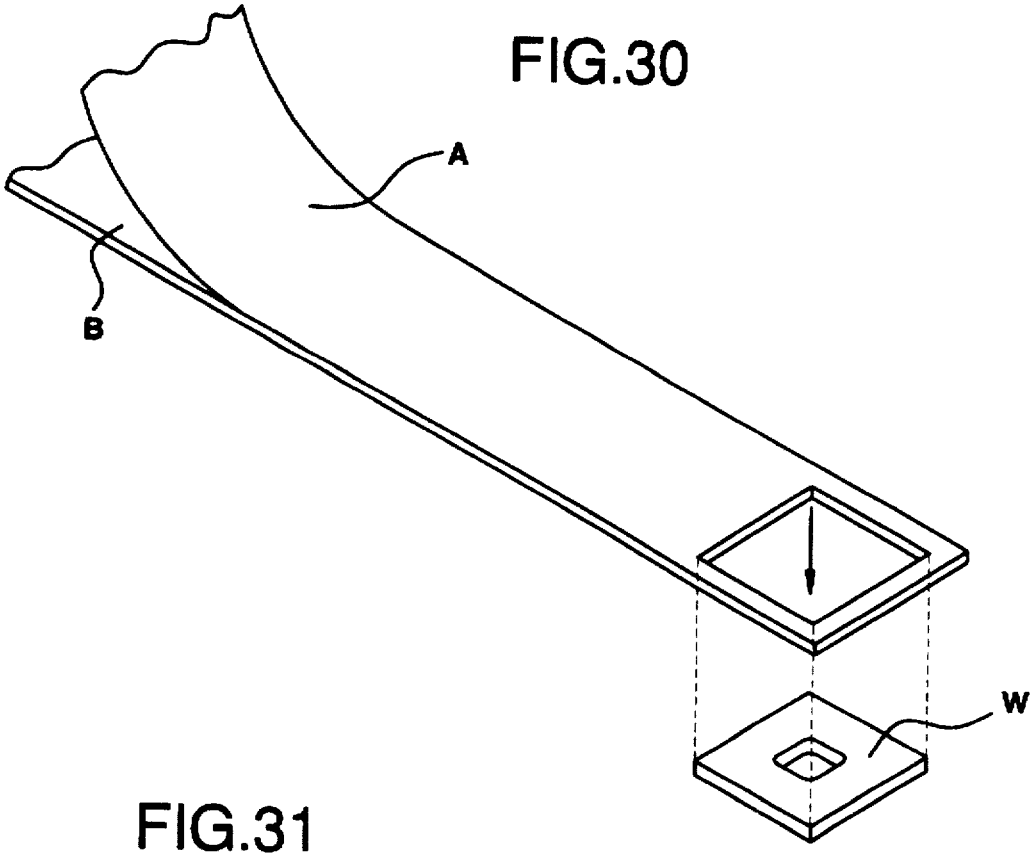
FIG. 30 is a schematic view of a forming a fuse in accordance with the present invention.

The details of the fuse W will be described. As shown in FIG. 30, epoxy based adhesive is coated on the surface of a plate fuse B of about 0.6 mm thick. On the adhesive layer, an insulating film A of polyimide resin is stacked to a thickness of about 15 μm. The fuse and the two layers are adhered together by thermal pressing and cut by a press machine to form a square fuse with an insulating film having a side length of 7 mm. A hole of generally square with a side length of about 2.0 mm is punched out by a press machine to form a washer shape fuse W.

Figure 31:
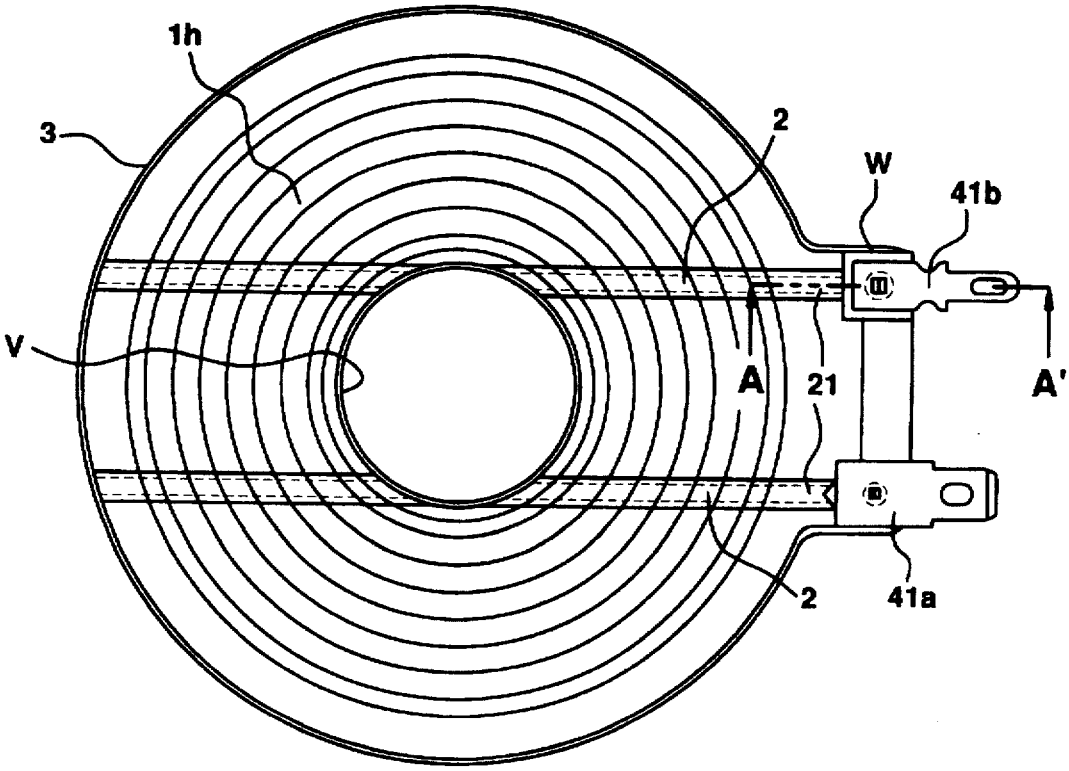
FIG. 31 is a schematic view of engaging the fuse with the terminal ring and the terminal lugs in accordance with the present invention.

In this embodiment, as shown in FIG. 31, a rectangular rod shape caulking portion **42*b* of the minus terminal lug 41*b* is inserted into the hole of the fuse W, with the polyimide resin film being faced toward the bottom of the terminal lug 41*b*. The terminal lug 41*b* with the fuse W being inserted is aligned with the square hole 32*b* of the terminal ring 3, and the caulking area is pressed and caulked. The fuse W is made of alloy of lead, tin, and the like and has a low rigidity. Therefore, the fuse W deforms during the caulking, and the inner wall of the square hole of the fuse W is strongly pushed to the outer side of the caulking area 42*b* and becomes in tight contact with the latter. The bottom of the fuse W is pressed against the front side of the flat knitted tinsel wire 21**.

Similar to the above work, the caulking area **42*a* of the terminal lug 41*a* on the press side is inserted into the square hole 32*a* of the terminal ring 3, and they are caulked with a press machine. In this manner, the bottom of the end portion of the terminal lug 41*a* becomes in tight contact with the front side of the end portion 21** of the flat knitted tinsel wire.

Since the fuse W is formed in a generally flat washer shape, the fuse W can be loaded by caulking with a press machine and by using speaker manufacture facilities and conventional techniques. Furthermore, loading the fuse W can be performed at the same time when the terminal lug 41 is caulked. Therefore, the fuse W can be loaded easily and with low cost.

Still further, the fuse W is pressed strongly against the terminal lug 41 and flat knitted tinsel wire 21 and against a conductive pattern 3P connected to the tinsel wire 21, by a caulking force. Therefore, the interconnection structure is simple and highly reliable.

An input signal path of the completed speaker routes from the connection area between the caulking area **42*b* of the terminal lug 41*b* and the square hole of the fuse W, to the bottom of the fuse W, to the front surface of the end portion 21 of the flat knitted tinsel wire of the damper 1, and to the voice coil V. When an input signal larger than a rated value is inputted, the fuse W at the minus terminal lug 41*b* melts and is removed from the loaded position to break the signal path. The insulating film 51 on the fuse surface is left on the bottom of the terminal lug 41*b* and the front surface of the flat knitted tinsel wire 2. Therefore, even if a force is applied to push the terminal lug 41*b* against the surface of the flat knitted tinsel wire 2, the left insulating film 51** stops a current flow.

In this embodiment, the fuse W is coated with the insulating film 51. The material of the insulating film 51 may be changed depending upon its application field, or the surface of the fuse may be coated only with an insulating layer of phenol resin or epoxy resin.

As compared to general audio speakers of home use, speakers mounted on vehicles require reliability with anti-vibration, water-proof, and heat resistance. Under a particular situation, for example, if a signal near an allowable limit is inputted under the condition of very high humidity, for example, if a signal at full volume is inputted at a desert area under a burning sun, then the speaker voice coil is heated more than the ordinary use conditions, and this heat burns the damper and also the diaphragm and at the worst, the vehicle itself may be burnt. Provision of the fuse W is effective for preventing such possible fire.

What is claimed is:

1. A speaker comprising:

a damper made of a base member and a flat tinsel wire, said base member having concentric corrugations and an opening formed generally at the center thereof, and said tinsel wire being sewn or woven into said base member and traversing the corrugations at a predetermined position aligned for electrical connection; a ring member made of insulating material and mounting said damper at an adhesive margin formed at the outer circumference thereof; a voice coil bobbin inserted into the opening of said damper and having a wound coil electrically connected to one end of said tinsel wire; and a terminal lug mounted on said ring member, said terminal lug being electrically connected to an end of an input lead wire and to the other end of said tinsel wire, wherein said ring member is provided with a projection part onto which said other end of the tinsel wire is sticked, said terminal lug is housed by a connector housing, and said other end of the tinsel wire, said projection part of said ring member and the terminal lug are gripped by the inner wall of said connector housing.

2. A speaker component according to claim 1, wherein said input lead wire includes a fuse.

3. A speaker component according to claim 1, wherein a network element is mounted onto said ring member.

4. A speaker component according to claim 1, wherein a wiring pattern is formed on the surface of said ring member.

* * * * *